US009352555B2

(12) United States Patent
Takahashi et al.

(10) Patent No.: US 9,352,555 B2
(45) Date of Patent: May 31, 2016

(54) INKJET PRINTER

(71) Applicant: RISO KAGAKU CORPORATION, Tokyo (JP)

(72) Inventors: Hisayuki Takahashi, Ibaraki (JP); Yoshiyuki Okada, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/473,098

(22) Filed: Aug. 29, 2014

(65) Prior Publication Data

US 2015/0070429 A1 Mar. 12, 2015

(30) Foreign Application Priority Data

Sep. 6, 2013 (JP) ..... 2013-185072
Sep. 30, 2013 (JP) ..... 2013-203724

(51) Int. Cl.

| | |
|---|---|
| ***B41J 29/38*** | (2006.01) |
| ***B41J 2/045*** | (2006.01) |
| ***B41J 2/14*** | (2006.01) |
| ***B41J 2/175*** | (2006.01) |
| ***B41J 2/18*** | (2006.01) |

(52) U.S. Cl.

CPC ..... *B41J 2/0454* (2013.01); *B41J 2/04563* (2013.01); *B41J 2/04581* (2013.01); *B41J 2/1433* (2013.01); *B41J 2/175* (2013.01); *B41J 2/18* (2013.01)

(58) Field of Classification Search

None

See application file for complete search history.

(56) References Cited

U.S. PATENT DOCUMENTS

| | | | | |
|---|---|---|---|---|
| 8,820,891 | B2 | 9/2014 | Bansyo | |
| 2010/0283808 | A1* | 11/2010 | Terakado et al. | 347/6 |
| 2013/0249986 | A1* | 9/2013 | Maesaka et al. | 347/10 |

FOREIGN PATENT DOCUMENTS

JP 2003-220714 8/2003

OTHER PUBLICATIONS

U.S. Appl. No. 14/468,798 to Hiroyuki Nakamura, filed Aug. 26, 2014.

U.S. Appl. No. 14/483,704 to Hiroyuki Nakamura, filed Sep. 11, 2014.

* cited by examiner

*Primary Examiner* — Erica Lin

(74) *Attorney, Agent, or Firm* — Greenblum & Bernstein, P.L.C.

(57) ABSTRACT

An inkjet printer is provided which can alleviate the degradation of print quality caused by the deviation of ink temperature from a proper temperature range. A controller performs printing while controlling the correspondence of ejection data to nozzle rows so that the ink temperature difference between regions caused by ink ejection operations may be smaller than that in the case where printing is performed with the correspondence of upstream nozzle row ejection data and downstream nozzle row ejection data to an upstream nozzle row and a downstream nozzle row fixed.

10 Claims, 24 Drawing Sheets

FIG.8A

PRINTING RATES IN EJECTION DATA (%)

| | 1ST PAGE | 2ND PAGE | 3RD PAGE | 4TH PAGE | 5TH PAGE | 6TH PAGE | 7TH PAGE |
|---|---|---|---|---|---|---|---|
| UPSTREAM NOZZLE ROW 12U | 15 | 30 | 20 | 30 | 40 | 10 | 5 |
| DOWNSTREAM NOZZLE ROW 12D | 20 | 15 | 15 | 15 | 20 | 10 | 10 |

FIG.8B

PRINTING RATE INEQUALITY RELATIONS IN EJECTION DATA

| | 1ST PAGE | 2ND PAGE | 3RD PAGE | 4TH PAGE | 5TH PAGE | 6TH PAGE | 7TH PAGE |
|---|---|---|---|---|---|---|---|
| UPSTREAM NOZZLE ROW 12U | SMALL | LARGE | LARGE | LARGE | LARGE | — | SMALL |
| DOWNSTREAM NOZZLE ROW 12D | LARGE | SMALL | SMALL | SMALL | SMALL | — | LARGE |

FIG.8C

PRINTING RATES AT TIME OF PRINTING (%)

| | 1ST PAGE | 2ND PAGE | 3RD PAGE | 4TH PAGE | 5TH PAGE | 6TH PAGE | 7TH PAGE |
|---|---|---|---|---|---|---|---|
| UPSTREAM NOZZLE ROW 12U | 15 | 30 | 15 | 30 | 20 | 10 | 10 |
| DOWNSTREAM NOZZLE ROW 12D | 20 | 15 | 20 | 15 | 40 | 10 | 5 |

FIG.8D

PRINTING RATE INEQUALITY RELATIONS AT TIME OF PRINTING

| | 1ST PAGE | 2ND PAGE | 3RD PAGE | 4TH PAGE | 5TH PAGE | 6TH PAGE | 7TH PAGE |
|---|---|---|---|---|---|---|---|
| UPSTREAM NOZZLE ROW 12U | SMALL | LARGE | SMALL | LARGE | SMALL | — | LARGE |
| DOWNSTREAM NOZZLE ROW 12D | LARGE | SMALL | LARGE | SMALL | LARGE | — | SMALL |

FIG.10A

PRINTING RATES IN EJECTION DATA (%)

| | 1ST PAGE | 2ND PAGE | 3RD PAGE | 4TH PAGE | 5TH PAGE | 6TH PAGE |
|---|---|---|---|---|---|---|
| Ru (UPSTREAM NOZZLE ROW 12U) | 15 | 30 | 20 | 30 | 40 | 5 |
| Rd (DOWNSTREAM NOZZLE ROW 12D) | 20 | 15 | 15 | 15 | 20 | 10 |

FIG.10B

| | 1ST PAGE | 2ND PAGE | 3RD PAGE | 4TH PAGE | 5TH PAGE | 6TH PAGE |
|---|---|---|---|---|---|---|
| PRINTING RATE DIFFERENCE Ru-Rd | -5 | 15 | 5 | 15 | 20 | -5 |

FIG.10C

| | 1ST PAGE | 2ND PAGE | 3RD PAGE | 4TH PAGE | 5TH PAGE | 6TH PAGE |
|---|---|---|---|---|---|---|
| \|T\| | 27.5 | 7.5 | 17.5 | 7.5 | 2.5 | 27.5 |

FIG.10D

PRINTING RATES AFTER REVERSING OPERATION (%)

| | 1ST PAGE | 2ND PAGE | 3RD PAGE | 4TH PAGE | 5TH PAGE | 6TH PAGE |
|---|---|---|---|---|---|---|
| UPSTREAM NOZZLE ROW 12U | 15 | 30 | 20 | 30 | 20 | 5 |
| DOWNSTREAM NOZZLE ROW 12D | 20 | 15 | 15 | 15 | 40 | 10 |

FIG.13A

INK TEMPERATURES (°C)

| | 1ST PAGE | 2ND PAGE | ··· | kTH PAGE | ··· |
|---|---|---|---|---|---|
| Tu (UPSTREAM REGION 21U) | 27 | 28 | ··· | 36 | ··· |
| Td (DOWNSTREAM REGION 21D) | 27 | 26 | ··· | 26 | ··· |

FIG.13B

PRINTING RATES IN EJECTION DATA (%)

| | 1ST PAGE | 2ND PAGE | ··· | kTH PAGE | ··· |
|---|---|---|---|---|---|
| UPSTREAM NOZZLE ROW 12U | 25 | 30 | ··· | 37 | ··· |
| DOWNSTREAM NOZZLE ROW 12D | 20 | 15 | ··· | 16 | ··· |

FIG.13C

PRINTING RATES AT TIME OF PRINTING (%)

| | 1ST PAGE | 2ND PAGE | ··· | kTH PAGE | ··· |
|---|---|---|---|---|---|
| UPSTREAM NOZZLE ROW 12U | 25 | 30 | ··· | 16 | ··· |
| DOWNSTREAM NOZZLE ROW 12D | 20 | 15 | ··· | 37 | ··· |

FIG.23

CUMURATIVE PRINTING RATES (%)

| | 1ST PAGE | 2ND PAGE | 3RD PAGE | 4TH PAGE | 5TH PAGE | 6TH PAGE | 7TH PAGE | 8TH PAGE |
|---|---|---|---|---|---|---|---|---|
| HEAD MODULE 61A | 15 | 45 | 65 | 95 | 135 | 140 | 155 | 177 |
| HEAD MODULE 61B | 20 | 30 | 60 | 80 | 110 | 125 | 139 | 176 |
| HEAD MODULE 61C | 30 | 50 | 80 | 100 | 115 | 140 | 160 | 180 |
| HEAD MODULE 61D | 13 | 26 | 50 | 70 | 90 | 99 | 120 | 155 |
| HEAD MODULE 61E | 25 | 55 | 70 | 75 | 87 | 94 | 117 | 137 |
| HEAD MODULE 61F | 18 | 33 | 68 | 80 | 100 | 130 | 150 | 160 |

FIG.24A

RESPECTIVE CUMULATIVE PRINTING RATES OF NOZZLE ROWS (%)

| | | 1ST PAGE | 2ND PAGE | 3RD PAGE |
|---|---|---|---|---|
| HEAD MODULE 61A | NOZZLE ROW 72U | 15 | 45 | 65 |
| | NOZZLE ROW 72D | 20 | 30 | 60 |
| HEAD MODULE 61B | NOZZLE ROW 72U | 30 | 50 | 80 |
| | NOZZLE ROW 72D | 13 | 26 | 50 |
| HEAD MODULE 61C | NOZZLE ROW 72U | 25 | 55 | 70 |
| | NOZZLE ROW 72D | 18 | 33 | 68 |
| HEAD MODULE 61D | NOZZLE ROW 72U | 15 | 45 | 65 |
| | NOZZLE ROW 72D | 20 | 30 | 60 |
| HEAD MODULE 61E | NOZZLE ROW 72U | 30 | 50 | 80 |
| | NOZZLE ROW 72D | 13 | 26 | 50 |
| HEAD MODULE 61F | NOZZLE ROW 72U | 25 | 55 | 70 |
| | NOZZLE ROW 72D | 18 | 33 | 68 |

FIG.24B

PRINTING RATES (%)

| | | 4TH PAGE |
|---|---|---|
| HEAD MODULE 61A | NOZZLE ROW 72U | 10 |
| | NOZZLE ROW 72D | 5 |
| HEAD MODULE 61B | NOZZLE ROW 72U | 10 |
| | NOZZLE ROW 72D | 3 |
| HEAD MODULE 61C | NOZZLE ROW 72U | 9 |
| | NOZZLE ROW 72D | 2 |
| HEAD MODULE 61D | NOZZLE ROW 72U | 10 |
| | NOZZLE ROW 72D | 15 |
| HEAD MODULE 61E | NOZZLE ROW 72U | 20 |
| | NOZZLE ROW 72D | 15 |
| HEAD MODULE 61F | NOZZLE ROW 72U | 10 |
| | NOZZLE ROW 72D | 6 |

FIG.24C

PRINTING RATES AFTER REVERSING OPERATION (%)

| | | 4TH PAGE |
|---|---|---|
| HEAD MODULE 61A | NOZZLE ROW 72U | 5 |
| | NOZZLE ROW 72D | 10 |
| HEAD MODULE 61B | NOZZLE ROW 72U | 3 |
| | NOZZLE ROW 72D | 10 |
| HEAD MODULE 61C | NOZZLE ROW 72U | 2 |
| | NOZZLE ROW 72D | 9 |
| HEAD MODULE 61D | NOZZLE ROW 72U | 15 |
| | NOZZLE ROW 72D | 10 |
| HEAD MODULE 61E | NOZZLE ROW 72U | 15 |
| | NOZZLE ROW 72D | 20 |
| HEAD MODULE 61F | NOZZLE ROW 72U | 6 |
| | NOZZLE ROW 72D | 10 |

INKJET PRINTER

BACKGROUND OF THE INVENTION

1. Field of the Invention

The present invention relates to an inkjet printer which performs printing by ejecting ink onto a print medium.

2. Description of the Related Art

Line-type inkjet printers have been known which performs printing by ejecting ink from a fixed inkjet head onto a sheet of paper while transporting the sheet of paper.

Some of such line-type inkjet printers include an inkjet head having an ink chamber partitioned into two regions and two nozzle rows configured to eject ink stored in the regions, respectively. The nozzle positions in one of the two nozzle rows are shifted from those in the other nozzle row in a main scanning direction by half of the nozzle pitch (half-pitch).

With such an inkjet head, two colors of ink can be ejected from one inkjet head. Alternatively, in the case where ink of the same color is ejected from the two nozzle rows, the printing resolution for that color can be improved.

In some inkjet printers, to maintain appropriate ink temperature during printing, the ink temperature is adjusted in an ink feed system (for example, see Japanese Patent Application Publication No. 2003-220714 (Patent Document 1)).

In inkjet heads, when an ink ejection operation is performed, the ink temperature in the inkjet head is increased by heat generated by components such as piezoelectric elements which cause the nozzles to eject ink.

In the case where the aforementioned inkjet head causes the two nozzle rows to eject ink of the same color distributed and fed through a common conduit, a difference between the operating rates of the two nozzle rows may cause an ink temperature difference between regions in the inkjet head which correspond to the nozzle rows. Further, as continuous printing time increases, the temperature difference may increase, and ink for one of the nozzle rows may deviate from a proper temperature range early. This may reduce the time during which printing can be performed at ink temperatures within the proper temperature range. The deviation of ink temperature from the proper temperature range results in, for example, unstable flight of ink, which causes degradation in print quality.

Adjusting ink temperature in the ink supply system as described in Patent Document 1 cannot alleviate the above-described ink temperature difference in the inkjet head.

SUMMARY OF THE INVENTION

The present invention has been made in view of the above-described circumstances, and an object of the present invention is to provide an inkjet printer which can alleviate the degradation of print quality.

To achieve the above-described object, a first aspect of the present invention provides an inkjet printer including an inkjet head and a controller. The inkjet head includes a first nozzle row, a second nozzle rows, and an ink chamber. Each of the first and second nozzle rows includes a plurality of nozzles arranged at predetermined intervals along a main scanning direction perpendicular to a transport direction of a sheet of paper transported. The nozzles in the first nozzle row are shifted from the nozzles in the second nozzle row in the main scanning direction. The first and second nozzle rows are spaced apart from each other in the transport direction. The ink chamber is partitioned into a first region configured to store ink to be ejected from the first nozzle row and a second region configured to store ink to be ejected from the second nozzle row, and is configured to store ink distributed from a common conduit and being to be supplied to the first and second regions. The inkjet head is configured to eject ink from the nozzles in the first and second nozzle rows onto the sheet of paper transported. The controller is configured to perform control based on first ejection data and second ejection data so that the nozzles in the first and second nozzle rows perform printing by ejecting ink line by line. The controller performs printing while controlling a the correspondence of the first and second ejection data to the first and second nozzle rows so that an ink temperature difference between the first region and the second region caused by ink ejection operations is made smaller than that in a case where printing is performed with the correspondence of the first and second ejection data to the first and second nozzle rows fixed.

According to a second aspect of the present invention, in the inkjet printer, the controller performs control for reversing the correspondence of the first and second ejection data to the first and second nozzle rows in predetermined units of printing.

According to a third aspect of the present invention, in the inkjet printer, the controller controls the correspondence of the ejection data to the nozzle rows using printing rates for each page in the first and second ejection data.

According to a fourth aspect of the present invention, the inkjet printer further includes a temperature sensor configured to detect ink temperatures in the first and second regions, and the controller controls the correspondence of the ejection data to the nozzle rows using printing rates for each page in the first and second ejection data and the ink temperatures in the first and second regions detected by the temperature sensor.

According to a fifth aspect of the present invention, in the inkjet printer, the inkjet head includes a plurality of head modules arranged along the main scanning direction in a staggered manner. Each of the head modules includes the first and second nozzle rows and the ink chamber. The controller controls the correspondence of the first and second ejection data to the first and second nozzle rows for each of the head modules so that an ink temperature difference between the first region and the second region caused by ink ejection operations is made smaller than that in a case where printing is performed with the correspondence of the ejection data to the nozzle rows fixed. In printing of each page, in a case where overlapping portions between the head modules include an overlapping portion without a continuous non-ejection region in which nozzles continuous in the main scanning direction are not to eject ink in printing performed with the original correspondence of the first and second ejection data to the first and second nozzle rows, the controller controls a cooperative head module group consisting of a plurality of the head modules continuous with each other across the overlapping portion without the continuous non-ejection region such that respective correspondences of the first and second ejection data to the first and second nozzle rows in the head modules of the cooperative head module group are controlled in conjunction with each other.

According to a sixth aspect of the present invention, in the inkjet printer, the controller controls the correspondence of the first and second ejection data to the first and second nozzle rows in each of the head modules so that a relation of inequality between printing rates of the first and second nozzle rows for a previous page or a relation of inequality between cumulative printing rates of the first and second nozzle rows up to the previous page is reverse to a relation of inequality between printing rates of the first and second nozzle rows for a current page. In printing of a page involving the cooperative head module group, the controller selects a reference head module from the cooperative head module group and controls the respective correspondences of the first and second ejection data to the first and second nozzle rows in the head modules of the cooperative head module group in conjunction with each other so that the relation of inequality between the printing rates of the first and second nozzle rows for the previous page or the relation of inequality between the cumulative printing rates of the first and second nozzle rows up to the previous page is reverse to the relation of inequality between the printing rates of the first and second nozzle rows for the current page in reference head module.

According to a seventh aspect of the present invention, in the inkjet printer, the controller selects the reference head module using a sum of the cumulative printing rates of the first and second nozzle rows in each of the head modules of the cooperative head module group.

According to an eighth aspect of the present invention, in the inkjet printer, in all the head modules, the controller performs control for reversing the correspondence of the first and second ejection data to the first and second nozzle rows in predetermined units of printing.

According to a ninth aspect of the present invention, the inkjet printer further includes a temperature sensor configured to detect respective ink temperatures in the first and second regions in each of the head modules. In each of the head modules, if an ink temperature difference between the first region and the second region is not less than a threshold value, the controller controls the correspondence of the first and second ejection data to the first and second nozzle rows so that one of the first and second nozzle rows to eject ink having a higher temperature has a lower printing rate. In printing of a page involving the cooperative head module group, the controller selects a reference head module from the cooperative head module group and, if the ink temperature difference between the first region and the second region in the reference head module is not less than the threshold value, controls the respective correspondences of the first and second ejection data to the first and second nozzle rows in the head modules of the cooperative head module group in conjunction with each other so that one of the first and second nozzle rows to eject ink having a higher temperature has a lower printing rate in the reference head module.

According to a tenth aspect of the present invention, in the inkjet printer, the controller selects the reference head module using ink temperatures detected by the temperature sensors in the head modules of the cooperative head module group.

In the inkjet printer according to the first aspect of the present invention, the controller performs printing while controlling the correspondence of the first and second ejection data to the first and second nozzle rows so that the ink temperature difference between the first region and the second region caused by ink ejection operations may be smaller than that in the case where printing is performed with the correspondence of the ejection data to the nozzle rows fixed. This control reduces the occurrence of an ink temperature deviation from a proper temperature range caused by a large ink temperature difference between the first region and the second region. This can prevent the reduction in the time during which printing can be performed at ink temperatures within the proper temperature range. As a result, the degradation of print quality caused by the deviation of ink temperature from the proper temperature range can be alleviated.

In the inkjet printer according to the second aspect of the present invention, the controller performs control for reversing the correspondence of the first and second ejection data to the first and second nozzle rows in predetermined units of printing. Thus, the ink temperature difference between the first region and the second region can be reduced by processing which places just a light load on the controller.

In the inkjet printer according to the third aspect of the present invention, the controller controls the correspondence of the ejection data to the nozzle rows using printing rates having large influences on ink temperature. Thus, an ink temperature difference occurring between the first region and the second region can be efficiently reduced.

In the inkjet printer according to the fourth aspect of the present invention, the controller controls the correspondence of the ejection data to the nozzle rows using printing rates for each page in the first and second ejection data and detected ink temperatures in the first and second regions. Thus, the ink temperature difference between the first region and the second region can be controlled with high accuracy.

In the inkjet printer according to the fifth aspect of the present invention, the controller controls the correspondence the first and second ejection data to the first and second nozzle rows for each head module so that the ink temperature difference between the first region and the second region caused by ink ejection operations may be smaller than that in the case where printing is performed with the correspondence of the ejection data to the nozzle rows fixed. This control reduces the occurrence of an ink temperature deviation from the proper temperature range caused by a large ink temperature difference between the first region and the second region. This can prevent the reduction in the time during which printing can be performed at ink temperatures within the proper temperature range.

Moreover, in the printing of each page, in the case where the overlapping portions between the head modules include one or more overlapping portions without continuous non-ejection regions, the controller controls a cooperative head module group consisting of a plurality of head modules continuous with each other across an overlapping portion without a continuous non-ejection region such that the respective correspondences of the first and second ejection data to the first and second nozzle rows in the head modules of the cooperative head module group are controlled in conjunction with each other. This can alleviate the degradation of print quality in an overlapping portion caused by the correspondences of the first and second ejection data to the first and second nozzle rows which are reverse to each other between adjacent head modules.

Accordingly, with the inkjet printer according to the fifth aspect of the present invention, the following can be achieved: in an inkjet printer which has an inkjet head including a plurality of head modules, while the degradation of print quality is alleviated in the overlapping portions between the head modules, the degradation of print quality caused by an ink temperature deviation from the proper temperature range is alleviated.

In the inkjet printer according to the sixth aspect of the present invention, the controller controls the correspondence of the first and second ejection data to the first and second nozzle rows using printing rates having large influences on ink temperature. Thus, the increase of the ink temperature difference between the first region and the second region can be efficiently reduced.

In the inkjet printer according to the seventh aspect of the present invention, the controller selects a reference head module using cumulative printing rates having large influences on ink temperature. Thus, a reference head module can be easily selected which is appropriate for a reference for the control of the correspondence of the first and second ejection data to the first and second nozzle rows in a cooperative head module group.

In the according to the eighth aspect of the present invention, for all the head modules, the controller performs control for reversing the correspondence of the first and second ejection data to the first and second nozzle rows in predetermined units of printing. Thus, the increase in the ink temperature difference between the first region and the second region can be reduced by processing which places just a light load on the controller.

In the inkjet printer according to the ninth aspect of the present invention, the controller controls the correspondence of the first and second ejection data to the first and second nozzle rows using the detected ink temperatures and printing rates having large influences on ink temperature. Thus, the ink temperature difference between the first region and the second region can be controlled with high accuracy.

In the inkjet printer according to the tenth aspect of the present invention, the controller selects a reference head module using the detected ink temperatures. Thus, a reference head module can be easily selected which is appropriate for a reference for the control of the correspondence of the first and second ejection data to the first and second nozzle rows in a cooperative head module group.

BRIEF DESCRIPTION OF DRAWINGS

FIG. 8A is an explanatory diagram showing printing rates in ejection data, FIG. 8B is an explanatory diagram showing printing rate inequality relations in FIG. 8A, FIG. 8C is an explanatory diagram showing printing rates at the time of printing, and FIG. 8D is an explanatory diagram showing printing rate inequality relations in FIG. 8C.

FIG. 10A is an explanatory diagram showing printing rates in ejection data, FIG. 10B is an explanatory diagram showing the difference between printing rates of the nozzle rows shown in FIG. 10A, FIG. 10C is an explanatory diagram showing the values of |T|, and FIG. 10D is an explanatory diagram showing printing rates after a reversing operation.

FIG. 13A is an explanatory diagram showing ink temperatures detected, FIG. 13B is an explanatory diagram showing printing rates in ejection data, and FIG. 13C is an explanatory diagram showing printing rates at the time of printing.

FIG. 23 is a view for explaining how to select a reference head module.

FIG. 24A is a view showing as an example a set of cumulative printing rates up to the previous page, FIG. 24B is a view showing as an example a set of printing rates for the current page, and FIG. 24C is a view showing printing rates after a reversing operation.

DESCRIPTION OF THE PREFERRED EMBODIMENTS

Figure 1:
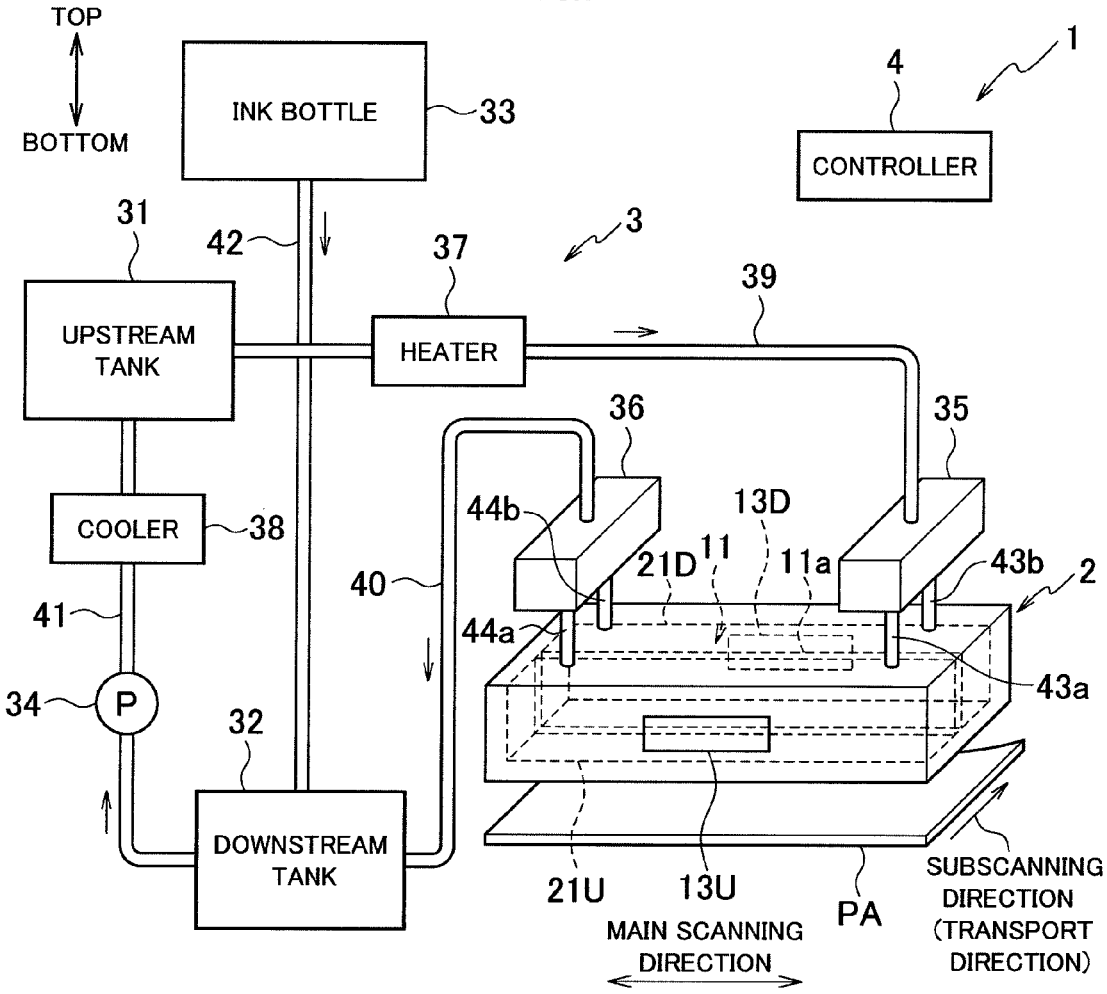
FIG. 1 is a view schematically showing the configuration of an inkjet printer according to a first embodiment.

Hereinafter, an embodiment of the present invention will be described with reference to the drawings. In the drawings, equal or equivalent portions and components are denoted by equal or equivalent reference numerals. It should be noted, however, that the drawings are schematic and different from reality. Moreover, it is a matter of course that the drawings may include portions in which dimensional relationships or proportions are different between drawings.

Moreover, embodiments described below are intended to illustrate examples of devices and the like for implementing technical principles of the invention, and the technical principles of the invention do not limit the materials, shapes, configurations, arrangement, and the like of components to ones described below. The technical principles of the invention allow various modifications within the scope of the appended claims.

(First Embodiment)

Figure 2:
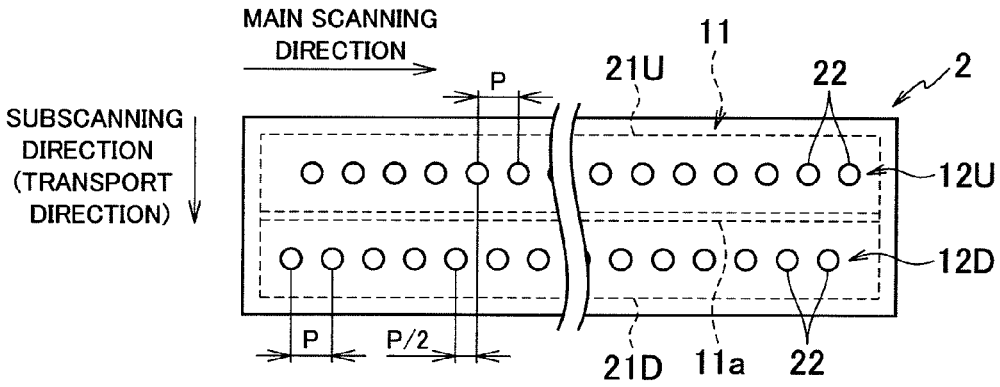
FIG. 2 is a view for explaining nozzle rows in an inkjet head of the inkjet printer shown in FIG. 1.

FIG. 1 is a view schematically showing the configuration of an inkjet printer according to a first embodiment of the present invention. FIG. 2 is a view for explaining nozzle rows in an inkjet head of the inkjet printer shown in FIG. 1. It should be noted that the top-bottom direction in the following description is the vertical direction and corresponds to the top-bottom direction of FIG. 1.

As shown in FIG. 1, an inkjet printer 1 according to the first embodiment includes an inkjet head 2, an ink circulation system 3, and a controller 4.

The inkjet head 2 ejects ink onto a sheet of paper PA which is being transported under the inkjet head 2 by an unillustrated transport system, thereby printing an image. As shown in FIGS. 1 and 2, the inkjet head 2 includes an ink chamber 11, nozzle rows 12U and 12D, and drivers 13U and 13D.

The ink chamber 11 stores ink supplied from the ink circulation system 3. In the ink chamber 11, a partition 11*a* is provided. The partition 11*a* is configured to partition the inside of the ink chamber 11 into a region 21U located upstream with respect to the transport direction of the sheet of paper PA and a region 21D located downstream with respect to the transport direction of the sheet of paper PA.

The regions 21U and 21D store ink of the same color supplied from an undermentioned conduit 39, which is a path common thereto, and distributed by an ink distributor 35. In the regions 21U and 21D, piezoelectric elements (not shown) are disposed to cause the nozzle rows 12U and 12D to eject ink. The upstream region 21U corresponds to the first region (or second region) described in the appended claims. The downstream region 21D corresponds to the second region (or first region) described in the appended claims.

As shown in FIG. 2, each of the nozzle rows 12U and 12D includes multiple nozzles 22. The nozzle rows 12U and 12D are disposed to be spaced apart from each other in a subscanning direction. The upstream nozzle row 12U corresponds to the first nozzle row (or second nozzle row) described in the appended claims. The downstream nozzle row 12D corresponds to the second nozzle row (or first nozzle row) described in the appended claims.

The nozzles 22 are configured to eject ink. The nozzles 22 have openings at the bottom of the inkjet head 2. The nozzles 22 in the upstream nozzle row 12U eject ink stored in the upstream region 21U of the ink chamber 11. The nozzles 22 in the downstream nozzle row 12D eject ink stored in the downstream region 21D of the ink chamber 11. In each of the nozzle rows 12U and 12D, the nozzles 22 are arranged along a main scanning direction and equally spaced with a predetermined pitch P. Moreover, the nozzles 22 in the nozzle row 12U and the nozzles 22 in the nozzle row 12D are shifted from each other by half of the pitch (P/2) in the main scanning direction.

The drivers 13U and 13D drive piezoelectric elements (not shown) disposed in the regions 21U and 21D to cause the nozzles 22 in the nozzle rows 12U and 12D to eject ink, respectively.

The ink circulation system 3 supplies ink to the inkjet head 2 while causing ink to circulate. The ink circulation system 3 includes an upstream tank 31, a downstream tank 32, an ink bottle 33, a pump 34, an ink distributor 35, a collector 36, a heater 37, a cooler 38, and conduits 39 to 42, 43*a*, 43*b*, 44*a*, and 44*b*.

The upstream tank 31 stores ink fed from the downstream tank 32, and supplies ink to the inkjet head 2.

The downstream tank 32 stores ink not consumed by the inkjet head 2 in ejection operation. The downstream tank 32 also stores ink supplied from the ink bottle 33.

The ink bottle 33 holds ink for use in printing by the inkjet printer 1. The ink bottle 33 supplies ink to the downstream tank 32.

The pump 34 feeds ink from the downstream tank 32 to the upstream tank 31. The pump 34 is provided at a point on the conduit 41 between the downstream tank 32 and the upstream tank 31.

The ink distributor 35 distributes ink supplied from the upstream tank 31 through the conduit 39, to the regions 21U and 21D of the ink chamber 11.

The collector 36 collects ink not consumed by the inkjet head 2 in ejection operation from the regions 21U and 21D of the ink chamber 11. The ink collected by the collector 36 flows into the downstream tank 32 through the conduit 40.

The heater 37 heats ink circulating in the ink circulation system 3. The heater 37 is provided at a point on the conduit 39 between the upstream tank 31 and the ink distributor 35.

The cooler 38 cools ink circulating in the ink circulation system 3. The cooler 38 includes a heatsink and a fan (both of which are not shown). The cooler 38 is provided at a point on the conduit 41 between the downstream tank 32 and the upstream tank 31.

The conduit 39 connects the upstream tank 31 and the ink distributor 35. The conduit 40 connects the collector 36 and the downstream tank 32. The conduit 41 connects the downstream tank 32 and the upstream tank 31. The conduit 42 connects the ink bottle 33 and the downstream tank 32. The conduit 43*a* connects the ink distributor 35 and the upstream region 21U of the ink chamber 11. The conduit 43*b* connects the ink distributor 35 and the downstream region 21D of the ink chamber 11. The conduit 44*a* connects the upstream region 21U of the ink chamber 11 and the collector 36. The conduit 44*b* connects the downstream region 21D of the ink chamber 11 and the collector 36.

The controller 4 controls the whole operation of the inkjet printer 1. The controller 4 is configured to include a CPU, a RAM, a ROM, a hard disk, and the like.

At the time of printing, the controller 4 performs control based on ejection data for the upstream nozzle row and ejection data for the downstream nozzle row so that the nozzles 22 in the nozzle rows 12U and 12D may eject ink line by line to perform printing.

The upstream nozzle row ejection data is data indicating the respective numbers of ink droplets (number of drops) which are ejected from the nozzles 22 in the upstream nozzle row 12U onto the corresponding pixels so that a printed image may be formed. The upstream nozzle row ejection data corresponds to the first ejection data (or second ejection data) described in the appended claims. The downstream nozzle row ejection data is data indicating the respective numbers of drops which are ejected from the nozzles 22 in the downstream nozzle row 12D onto the corresponding pixels so that a printed image may be formed. The downstream nozzle row ejection data corresponds to the second ejection data (or first ejection data) described in the appended claims.

As described above, the upstream nozzle row ejection data and the downstream nozzle row ejection data are generated as data corresponding to the upstream nozzle row 12U and the downstream nozzle row 12D, respectively. However, the controller 4 performs printing while controlling the correspondence of the ejection data to the nozzle rows 12U and 12D so that the ink temperature difference between the regions 21U and 21D caused by ink ejection operations may be smaller than that in the case where printing is performed with the above-described correspondence of the ejection data to the nozzle rows 12U and 12D fixed.

Specifically, the controller 4 performs control for reversing the correspondence of the upstream nozzle row ejection data and the downstream nozzle row ejection data to the nozzle rows 12U and 12D in predetermined units of printing.

Next, the operation of the inkjet printer 1 will be described.

When print data is inputted, the controller 4 starts a printing operation. The print data contains upstream nozzle row ejection data and downstream nozzle row ejection data.

When the printing operation is started, the controller 4 actuates the pump 34 of the ink circulation system 3 and thereby causes ink to circulate. The controller 4 determines based on ink temperature detected by an unillustrated thermometer whether or not the temperature of ink in the ink circulation system 3 is within a proper temperature range. If the controller 4 determines that the temperature of the ink is not within the proper temperature range, the controller 4 adjusts the ink temperature using the heater 37 and the cooler 38 while causing ink to circulate.

Then, the controller 4 causes the nozzle rows 12U and 12D of the inkjet head 2 to eject ink based on the upstream nozzle row ejection data and the downstream nozzle row ejection data while causing an unillustrated transport system to transport a sheet of paper PA. Thus, an image is printed on the sheet of paper PA.

In the printing operation, the controller 4 performs printing while reversing the correspondence of the ejection data to the nozzle rows 12U and 12D in predetermined units of printing. Specifically, the controller 4 reverses the correspondence of the ejection data to the nozzle rows 12U and 12D on a page-by-page basis.

For example, for the first page, the controller 4 causes the upstream nozzle row 12U to eject ink based on the upstream nozzle row ejection data, and causes the downstream nozzle row 12D to eject ink based on the downstream nozzle row ejection data. For the second page, the controller 4 reverses the correspondence of the ejection data to the nozzle rows 12U and 12D from that of the first page. Specifically, for the second page, the controller 4 causes the upstream nozzle row 12U to eject ink based on the downstream nozzle row ejection data, and causes the downstream nozzle row 12D to eject ink based on the upstream nozzle row ejection data.

After that, for odd-numbered pages, the correspondence of the ejection data to the nozzle rows 12U and 12D is the same as that of the first page. For even-numbered pages, the correspondence of the ejection data to the nozzle rows 12U and 12D is the same as that of the second page.

Figure 3:
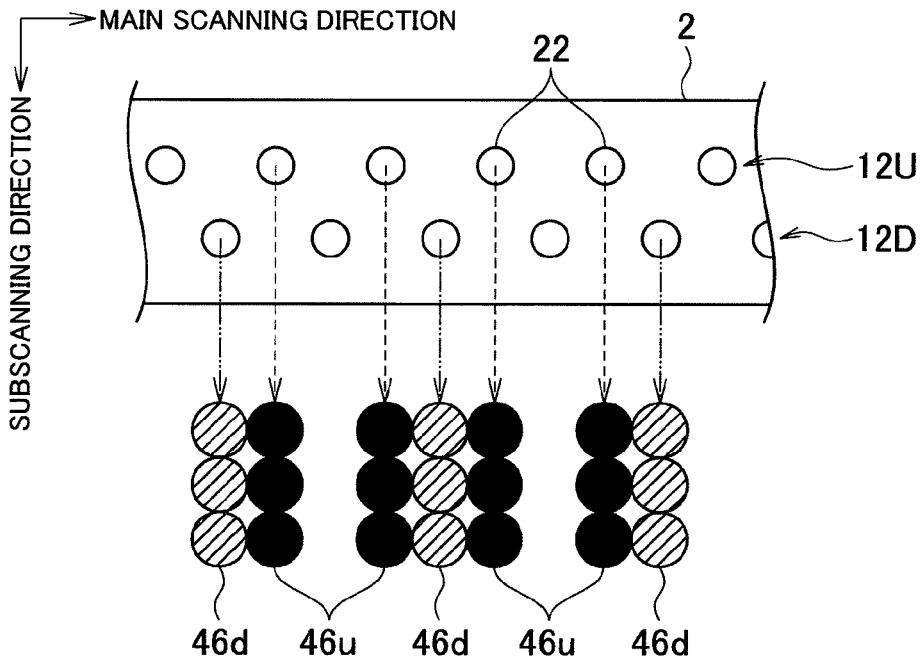
FIG. 3 is a view for explaining the formation of dots by the ejection of ink from an upstream nozzle row and a downstream nozzle row.
Figure 4:
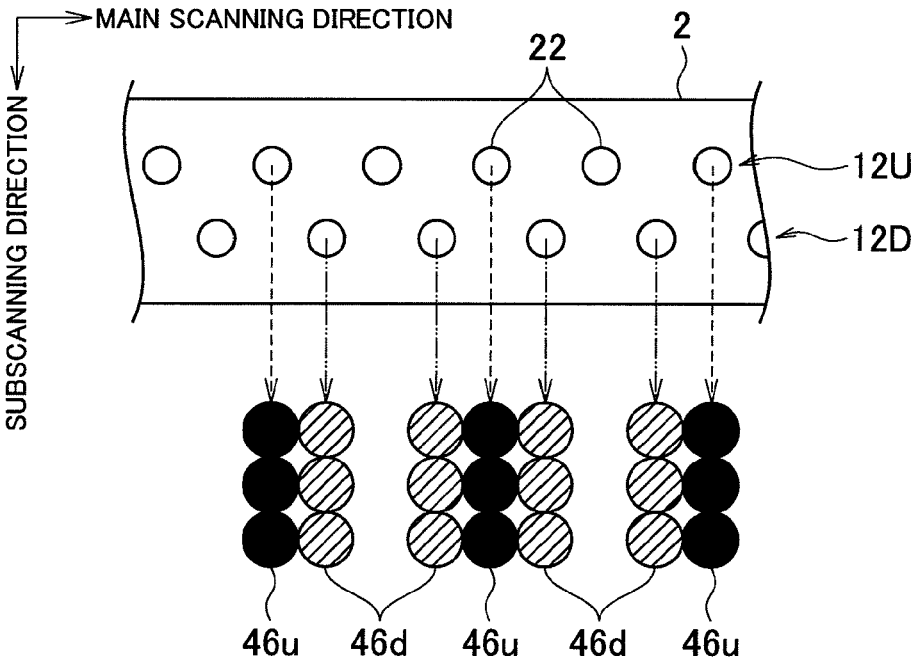
FIG. 4 is a view for explaining the formation of dots by the ejection of ink from the upstream nozzle row and the downstream nozzle row.

With the above-described control, in the case where dots are formed as shown in FIG. 3 on odd-numbered pages, dots are formed as shown in FIG. 4 on even-numbered pages.

In FIGS. 3 and 4, dots 46*u* represent dots formed on the sheet of paper PA by ink ejected from the nozzles 22 in the upstream nozzle row 12U. Dots 46*d* represent dots formed on the sheet of paper PA by ink ejected from the nozzles 22 in the downstream nozzle row 12D. It should be noted that since the nozzle rows 12U and 12D eject ink of the same color, the dots 46*u* and 46*d* are dots of the same color.

At the time of printing, after the ejection of ink from the nozzles 22 in the upstream nozzle row 12U forms a line of dots 46*u* on the sheet of paper PA, ink is ejected from the downstream nozzle row 12D with such a timing that dots 46*d* are formed on the same line as the dots 46*u*. In this way, a printed image is formed line by line on the sheet of paper PA which is being transported.

As shown in FIGS. 3 and 4, the reversal of the correspondence of the ejection data to the nozzle rows 12U and 12D causes the printed image to be shifted by half of the pitch in the main scanning direction, but an equivalent printed image is formed.

In the inkjet head 2, when an ink ejection operation is performed, the piezoelectric elements and the drivers 13U and 13D generate heat. The heat thus generated increases the ink temperatures in the regions 21U and 21D of the ink chamber 11. As the printing rates of the nozzle rows 12U and 12D increase, the temperatures of the piezoelectric elements and the drivers 13U and 13D are prone to increase.

In the case where unlike the above-described control, printing is performed with the correspondence of the ejection data to the nozzle rows 12U and 12D fixed, an ink temperature difference may occur between the regions 21U and 21D due to the printing rate difference between the nozzle rows 12U and 12D.

For example, the following assumptions are made: multiple pages, the images of which are the same, are printed; the printing rate in the upstream nozzle row ejection data is larger than that in the downstream nozzle row ejection data; and the multiple pages are continuously printed by causing the upstream nozzle row 12U to eject ink based on the upstream nozzle row ejection data and causing the downstream nozzle row 12D to eject ink based on the downstream nozzle row ejection data.

Figure 5:
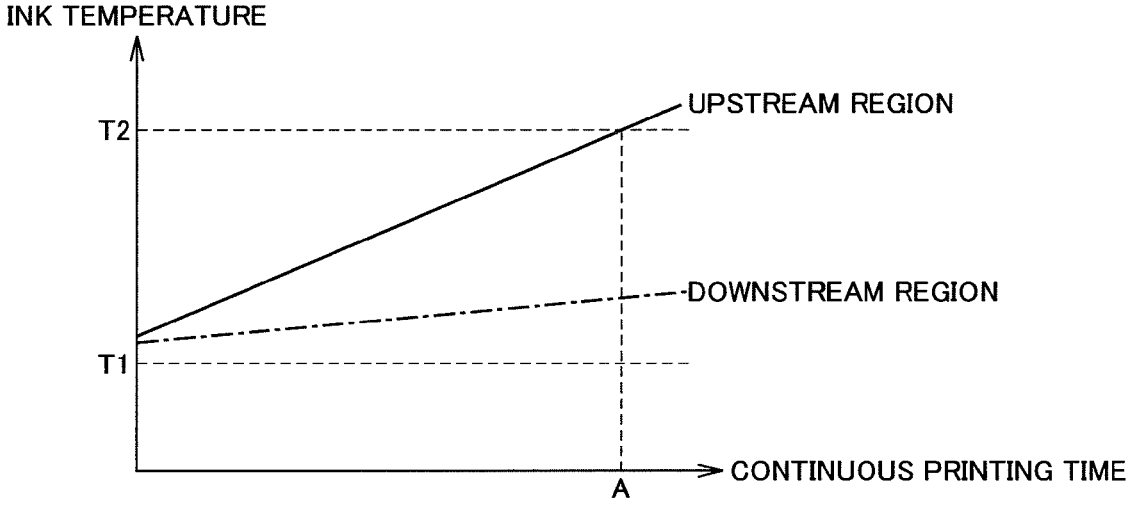
FIG. 5 is an explanatory diagram showing ink temperature change for the case where there is an ink temperature difference between an upstream region and a downstream region of an ink chamber.

In that case, as shown in FIG. 5, as continuous printing time increases, the ink temperature difference between the upstream region 21U and the downstream region 21D increases. Thus, the temperature of ink in the upstream region 21U may exceed a maximum temperature T2 of the proper temperature range (T1 to T2). When the temperature of ink in the upstream region 21U exceeds the maximum temperature T2, for example, the flight of ink ejected from the upstream nozzle row 12U becomes unstable, and print quality may be degraded.

Figure 6:
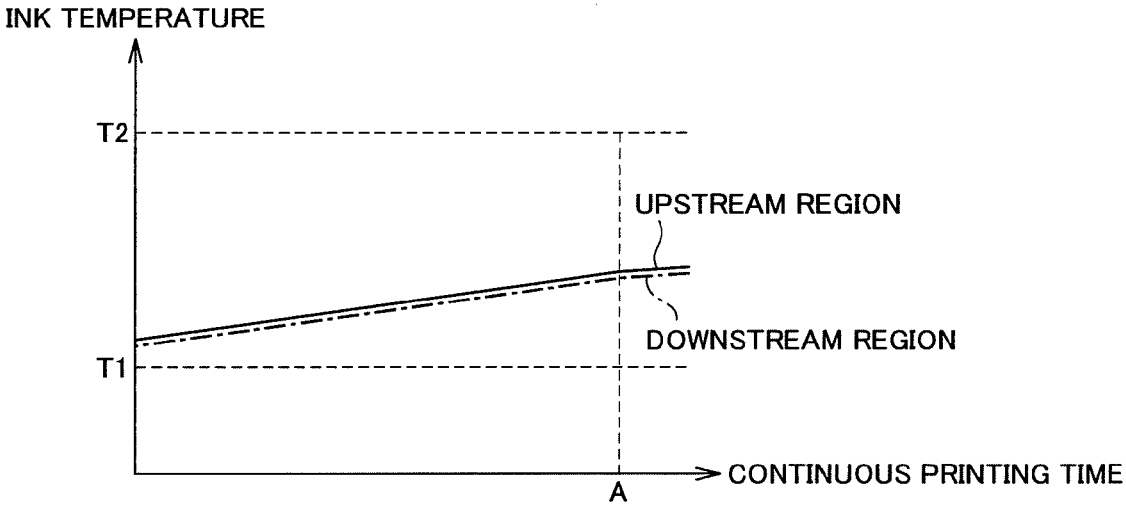
FIG. 6 is an explanatory diagram showing ink temperature change for the case where the ink temperature difference between the upstream region and the downstream region of the ink chamber is reduced.

On the other hand, with the aforementioned control for reversing the correspondence of the ejection data to the nozzle rows 12U and 12D on a page-by-page basis, printing rates can be distributed between the nozzle rows 12U and 12D. In particular, in the case of the printing of multiple pages, the images of which are the same, the reversal of the correspondence of the ejection data to the nozzle rows 12U and 12D on a page-by-page basis reverses the printing rates of the nozzle rows 12U and 12D on a page-by-page basis, thus averaging the printing rates between the nozzle rows 12U and 12D. This makes the ink temperature difference between the upstream region 21U and the downstream region 21D negligible as shown in FIG. 6. Even at continuous printing time A at which the temperature of ink in the upstream region 21U exceeds the maximum temperature T2 in FIG. 5, the ink temperatures in the upstream region 21U and the downstream region 21D are maintained within the proper temperature range.

As described above, in the inkjet printer 1, the controller 4 performs printing while controlling the correspondence of the ejection data to the nozzle rows 12U and 12D so that the ink temperature difference between the regions 21U and 21D caused by ink ejection operations may be smaller than that in the case where printing is performed with the correspondence of the ejection data to the nozzle rows 12U and 12D fixed. Specifically, the controller 4 performs control for reversing the correspondence of the upstream nozzle row ejection data and the downstream nozzle row ejection data to the nozzle rows 12U and 12D in predetermined units of printing.

This control reduces the occurrence of an ink temperature deviation from the proper temperature range caused by a large ink temperature difference between the regions 21U and 21D in the inkjet head 2. This can alleviate the reduction in the time during which printing can be performed at ink temperatures within the proper temperature range. As a result, the degradation of print quality caused by an ink temperature deviation from the proper temperature range can be alleviated.

Moreover, since the control is just for reversing the correspondence of the ejection data to the nozzle rows 12U and 12D in predetermined units of printing, the ink temperature difference between the regions 21U and 21D can be reduced by processing which places just a light load on the controller 4.

It should be noted that though the printing unit for the reversal of the correspondence of the ejection data to the nozzle rows 12U and 12D is one page in the above description, the present invention is not limited to this. For example, reversal may be performed in units consisting of several pages. In that case, also, printing rates can be distributed between the nozzle rows 12U and 12D.

(Second Embodiment)

Figure 7:
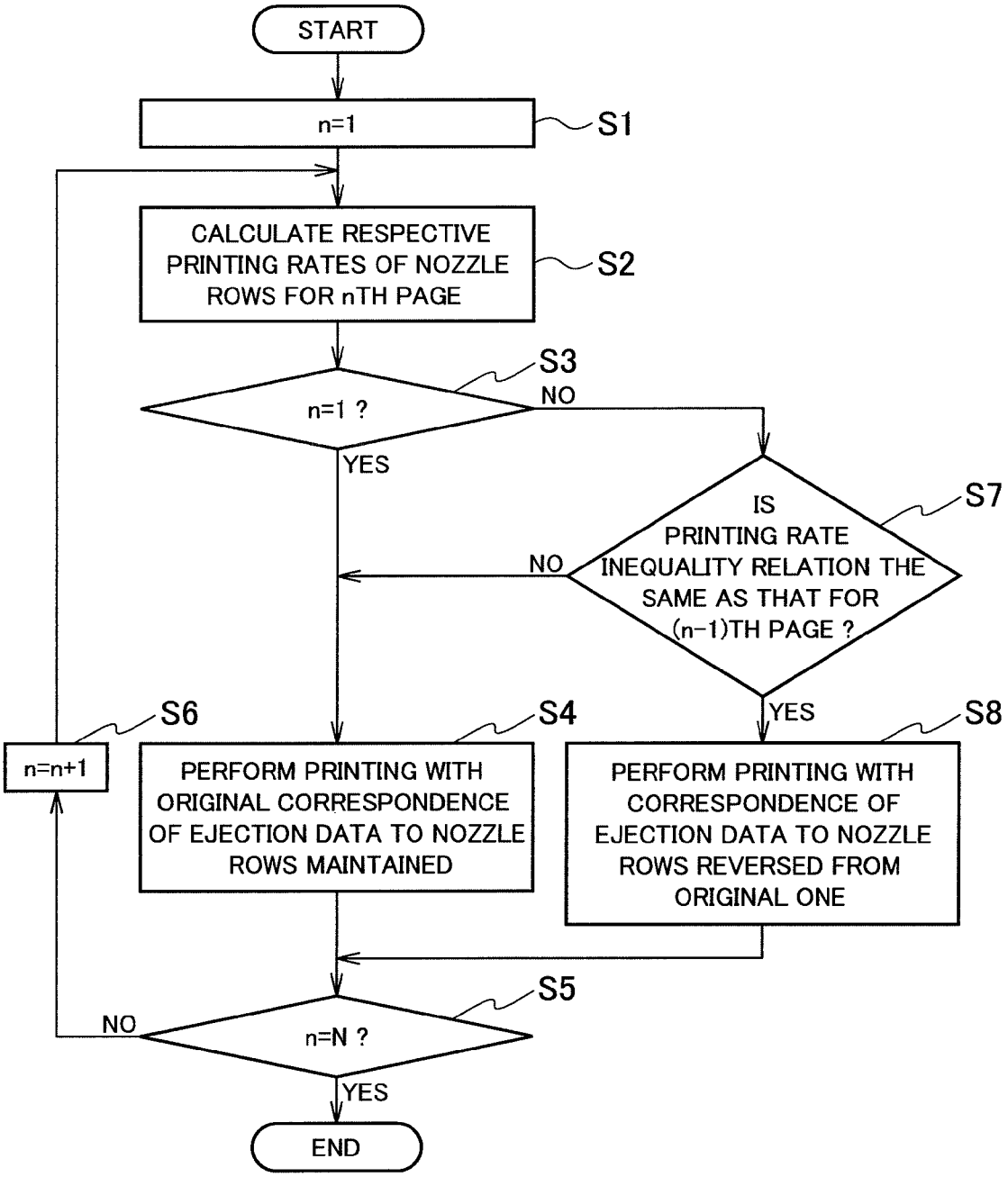
FIG. 7 is a flowchart for explaining the control of the correspondence of ejection data to the nozzle rows in a second embodiment.

Next, a second embodiment will be described. FIG. 7 is a flowchart for explaining the control of the correspondence of ejection data to nozzle rows in the second embodiment. It should be noted that since the configuration of an inkjet printer according to the second embodiment is similar to that of the inkjet printer 1 of the first embodiment shown in FIG. 1, FIG. 1 is also referenced in the second embodiment.

Processing represented by the flowchart in FIG. 7 is started by the input of print data into the inkjet printer 1.

In step S1 of FIG. 7, the controller 4 assigns "1" to a variable n, which indicates a page number.

Subsequently, in step S2, the controller 4 calculates the printing rates of the nozzle rows 12U and 12D for the nth page. Specifically, the controller 4 calculates the printing rate for the nth page in the upstream nozzle row ejection data and the printing rate for the nth page in the downstream nozzle row ejection data. The printing rate in the upstream nozzle row ejection data is the rate of the number of pixels having non-zero drop numbers (pixels onto which ink is ejected) to the total number of pixels corresponding to the nozzles 22 in the nozzle row 12U. The printing rate in the downstream nozzle row ejection data is similar.

Then, in step S3, the controller 4 determines whether the variable n is "1" or not.

If the controller 4 determines that the variable n is "1" (step S3: YES), the controller 4 performs printing in step S4 with the original correspondence of the ejection data to the nozzle rows 12U and 12D maintained. Specifically, the controller 4 performs printing by causing the upstream nozzle row 12U to eject ink based on the upstream nozzle row ejection data and causing the downstream nozzle row 12D to eject ink based on the downstream nozzle row ejection data.

After that, in step S5, the controller 4 determines whether or not the variable n is "N," which indicates a last page. If the controller 4 determines that the variable n is "N" (step S5: YES), the controller 4 terminates the processing.

If the controller 4 determines that the variable n is not "N" (step S5: NO), the controller 4 adds "1" to the variable n in step S6. Then, the controller 4 returns to step S2.

If in step S3 the controller 4 determines that the variable n is not "1" (step S3: NO), the controller 4 determines in step S7 based on the result of calculation in step S2 whether or not the relation of inequality between the printing rates of the nozzle rows 12U and 12D (printing rate inequality relation) for the nth page is the same as that at the time of printing the (n−1)th page.

It should be noted that if the printing rates of the nozzle rows 12U and 12D at the time of printing the (n−1)th page are equal (there is no inequality relation), a determination is made based on the (n−2)th page. The preceding pages are searched in reverse order until a page having a difference (there is an inequality relation) between the printing rates of the nozzle rows 12U and 12D at the time of printing is found, and a determination is made based on the found page.

If the controller 4 determines that the printing rate inequality relations are not the same (step S7: NO), the controller 4 goes to step S4.

If the controller 4 determines that the printing rate inequality relations are the same (step S7: YES), the controller 4 performs printing in step S8 with the correspondence of the ejection data to the nozzle rows 12U and 12D reversed from the original correspondence. Specifically, the controller 4 performs printing by causing the upstream nozzle row 12U to eject ink based on the downstream nozzle row ejection data and causing the downstream nozzle row 12D to eject ink based on the upstream nozzle row ejection data. Then, the controller 4 goes to step S5.

An explanation of the above-described control of the correspondence of the ejection data to the nozzle rows 12U and 12D will be made using an example shown in FIGS. 8A to 8D.

FIG. 8A shows as an example a set of printing rates of the nozzle rows 12U and 12D for each page calculated in the above-described step S2 of FIG. 7. FIG. 8B shows the relation of inequality between the printing rates for each page shown in FIG. 8A. FIG. 8C shows the printing rates of the nozzle rows 12U and 12D for each page which are applied when printing is performed by the processing represented by the flowchart in FIG. 7 using ejection data having the printing rates shown in FIG. 8A. FIG. 8D shows the relation of inequality between the printing rates for each page shown in FIG. 8C.

As described with reference to the flowchart in FIG. 7, the first page is printed with the original correspondence of the ejection data to the nozzle rows 12U and 12D maintained. For the second page, the printing rate inequality relation for the second page in the ejection data is compared with the printing rate inequality relation at the time of printing the first page (step S7).

In the example of FIGS. 8A to 8D, the printing rate inequality relation for the second page in the ejection data shown in FIG. 8B is not the same as the printing rate inequality relation at the time of printing the first page shown in FIG. 8D. Accordingly, the second page is printed with the original correspondence of the ejection data to the nozzle rows 12U and 12D maintained (step S4). Thus, as shown in FIG. 8C, the printing rates of the nozzle rows 12U and 12D at the time of printing the second page are the same as the printing rates of the nozzle rows 12U and 12D for the second page in FIG. 8A.

For the third page, the printing rate inequality relation for the third page in the ejection data is compared with the printing rate inequality relation at the time of printing the second page (step S7).

In the example of FIGS. 8A to 8D, the printing rate inequality relation for the third page in the ejection data shown in FIG. 8B is the same as the printing rate inequality relation at the time of printing the second page shown in FIG. 8D. Accordingly, the third page is printed with the correspondence of the ejection data to the nozzle rows 12U and 12D reversed from the original correspondence (step S8). Thus, as shown in FIG. 8C, the printing rates of the nozzle rows 12U and 12D at the time of printing the third page are reverse to the printing rates of the nozzle rows 12U and 12D for the third page in FIG. 8A.

For the fourth page, the printing rate inequality relation for the fourth page in the ejection data is compared with the printing rate inequality relation at the time of printing the third page (step S7).

In the example of FIGS. 8A to 8D, the printing rate inequality relation for the fourth page in the ejection data shown in FIG. 8B is not the same as the printing rate inequality relation at the time of printing the third page shown in FIG. 8D. Accordingly, the fourth page is printed with the original correspondence of the ejection data to the nozzle rows 12U and 12D maintained (step S4). Thus, as shown in FIG. 8C, the printing rates of the nozzle rows 12U and 12D at the time of printing the fourth page are the same as the printing rates of the nozzle rows 12U and 12D for the fourth page in FIG. 8A.

For the fifth page and the following pages, processing is performed as described above. Thus, printing is performed such that the relation of inequality between the printing rates of the nozzle rows 12U and 12D is reversed on a page-by-page basis, except for a page or pages in which the printing rates of the nozzle rows 12U and 12D are equal, as shown in FIGS. 8C and 8D.

As described above, in the second embodiment, the controller 4 controls the correspondence of the ejection data to the nozzle rows 12U and 12D using the printing rates for each page in the upstream nozzle row ejection data and the downstream nozzle row ejection data. Specifically, the controller 4 controls the correspondence of the ejection data to the nozzle rows 12U and 12D so that the relation of inequality between the printing rates of the nozzle rows 12U and 12D at the time of printing may be reversed on a page-by-page basis. Thus, by using printing rates, which have large influences on ink temperature, an ink temperature difference occurring between the regions 21U and 21D can be efficiently reduced. Moreover, since the relation of inequality between the printing rates of the nozzle rows 12U and 12D at the time of printing is reversed on a page-by-page basis, the above-described effect can be obtained for any type of image to be printed, by processing which places just a relatively light load on the controller 4.

(Third Embodiment)

Figure 9:
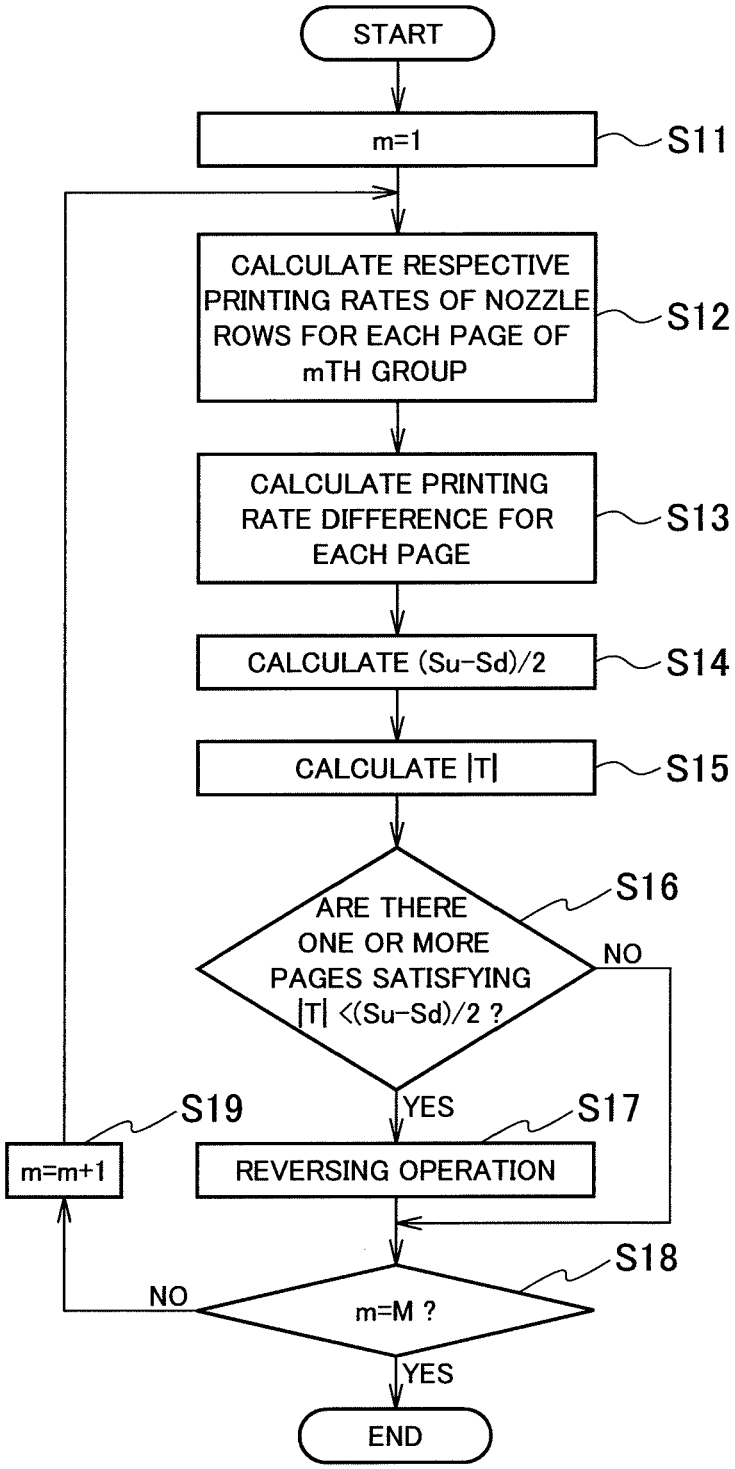
FIG. 9 is a flowchart for explaining the control of the correspondence of ejection data to the nozzle rows in a third embodiment.

Next, a third embodiment will be described. FIG. 9 is a flowchart for explaining the control of the correspondence of ejection data to nozzle rows in the third embodiment. It should be noted that since the configuration of an inkjet printer according to the third embodiment is similar to that of the inkjet printer 1 of the first embodiment shown in FIG. 1, FIG. 1 is also referenced in the third embodiment.

Processing represented by the flowchart in FIG. 9 is started by the input of print data into the inkjet printer 1.

In step S11 of FIG. 9, the controller 4 assigns "1" to a variable m, which indicates a group number. A group is the unit of this processing and consists of a predetermined number of pages. The controller 4 divides pages of the print data into groups, each consisting of the predetermined number of pages, from the first page.

Subsequently, in step S12, the controller 4 calculates the printing rates of the nozzle rows 12U and 12D for each page of the mth group. Specifically, the controller 4 calculates the printing rate Ru for each page in the upstream nozzle row ejection data and the printing rate Rd for each page in the downstream nozzle row ejection data.

Then, in step S13, the controller 4 calculates a printing rate difference (Ru−Rd) for each page. For example, in the case where the printing rates Ru and Rd for each page of a 6-page group are calculated as shown in FIG. 10A in step S12, the printing rate difference (Ru−Rd) for each page is calculated as shown in FIG. 10B.

After that, in step S14, the controller 4 calculates (Su−Sd)/2. The value Su is the sum of the respective printing rates Ru for the six pages. The value Sd is the sum of the respective printing rates Rd for the six pages. In the example of FIGS. 10A to 10D, Su and Sd are calculated as follows:

$$Su=15+30+20+30+40+5=140, \text{ and } Sd=20+15+15+15+20+10=95.$$

Accordingly, (Su−Sd)/2 is calculated as follows:

$$(Su-Sd)/2=22.5.$$

Subsequently, in step S15, the controller 4 calculates the absolute value |T| of a value T obtained by subtracting the printing rate difference (Ru−Rd) from (Su−Sd)/2 for each page. For the first page of the example of FIGS. 10A to 10D, since the printing rate difference (Ru−Rd)=−5, T and |T| are calculated as follows:

$$T=22.5-(-5)=27.5, \text{ and } |T|=27.5.$$

In this way, |T| is calculated for each page as shown in FIG. 10C.

Then, in step S16, the controller 4 determines whether or not there are one or more pages satisfying the following inequality (1):

$$|T|<(Su-Sd)/2 \quad (1)$$

If the controller 4 determines that there are one or more pages satisfying the inequality (1) (step S16: YES), the controller 4 performs a reversing operation in step S17. Specifically, the controller 4 reverses the correspondence of the ejection data to the nozzle rows 12U and 12D for the page having a smallest value of |T| from the original correspondence.

In the example of FIGS. 10A to 10D, the second to fifth pages satisfy |T|<22.5, thus satisfying the inequality (1). Among the second to fifth pages, the fifth page has a smallest value of |T|. Accordingly, the controller 4 reverses the correspondence of the ejection data to the nozzle rows 12U and 12D for the fifth page from the original correspondence. Specifically, for the fifth page, the controller 4 correlates the downstream nozzle row ejection data with the upstream nozzle row 12U and correlates the upstream nozzle row ejection data with the downstream nozzle row 12D. Thus, as shown in FIG. 10D, the printing rates of the nozzle rows 12U and 12D for the fifth page are reversed from those in FIG. 10A.

As described above, by reversing the correspondence of the ejection data to the nozzle rows 12U and 12D for a page having a smallest value of |T| among pages satisfying the inequality (1), the difference between the printing rate sums (averages) of the nozzle rows 12U and 12D can be reduced close to zero.

In the example of FIGS. 10A to 10D, as shown in FIG. 10D, the printing rate sum Su' of the upstream nozzle row 12U after the reversing operation is calculated as follows:

$$Su'=15+30+20+30+20+5=120$$

Further, the printing rate sum Sd' of the downstream nozzle row 12D after the reversing operation is calculated as follows:

$$Sd'=20+15+15+15+40+10=115.$$

Accordingly, the difference between the printing rate sums of the nozzle rows 12U and 12D is calculated as follows:

$$Su'-Sd'=120-115=5.$$

Before the reversing operation, the difference between the printing rate sums of the nozzle rows 12U and 12D is calculated as follows:

$$Su-Sd=140-95=45.$$

Thus, with the reversing operation, the difference between the printing rate sums of the nozzle rows 12U and 12D can be reduced close to zero.

Subsequently, in step S18, the controller 4 determines whether or not the variable m is "M," which indicates a last group. If the controller 4 determines that the variable m is "M" (step S18: YES), the controller 4 terminates the processing.

If the controller 4 determines that the variable m is not "M" (step S18: NO), the controller 4 adds "1" to the variable m in step S19. After that, the controller 4 returns to step S12.

In the case where there is no page satisfying the inequality (1), there is no page which allows the difference between the printing rate sums of the nozzle rows 12U and 12D to be reduced close to zero by the reversal of the correspondence of the ejection data to the nozzle rows 12U and 12D. Accordingly, if in step S16 the controller 4 determines that there is no page satisfying the inequality (1) (step S16: NO), the controller 4 skips step S17 and goes to step S18.

When processing in step S17 is completed, or when the determination is "NO" in step S16, the mth group becomes ready for printing. The controller 4 sequentially performs the printing of groups which are ready for printing, in parallel with the processing represented by the flowchart in FIG. 9.

It should be noted that a threshold value may be set for the difference (Su'−Sd') between the printing rate sums of the nozzle rows 12U and 12D after the reversing operation so that a group or groups having values of (Su'−Sd') which are not less than the threshold value may each be divided into several groups. In that case, processing similar to that represented by the flowchart in FIG. 9 can be performed with each of the groups after division regarded as the unit of processing.

As described above, in the third embodiment, the controller 4 controls the correspondence of the ejection data to the nozzle rows 12U and 12D so that the difference between the printing rate sums (averages) of the nozzle rows 12U and 12D may be reduced close to zero. With this control, the ink temperature difference between the regions 21U and 21D can be reduced with high accuracy for any type of image to be printed.

(Fourth Embodiment)

Figure 11:
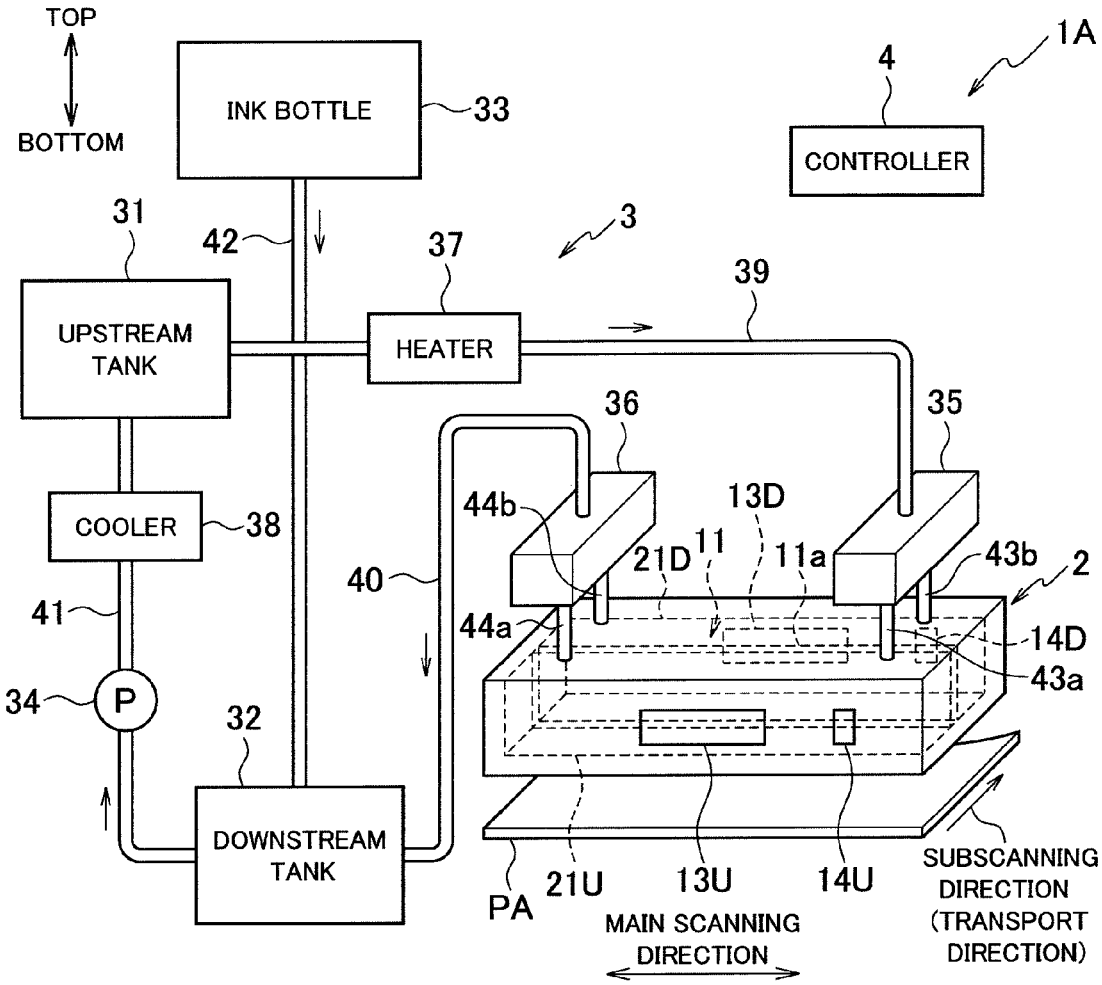
FIG. 11 is a view schematically showing the configuration of an inkjet printer according to a fourth embodiment.

Next, a fourth embodiment will be described. FIG. 11 is a view schematically showing the configuration of an inkjet printer according to a fourth embodiment.

As shown in FIG. 11, an inkjet printer 1A according to the fourth embodiment has a configuration obtained by adding temperature sensors 14U and 14D to the inkjet printer 1 in FIG. 1.

The temperature sensors 14U and 14D detect ink temperatures in the regions 21U and 21D of the ink chamber 11, respectively. The temperature sensors 14U and 14D correspond to the temperature sensor described in the appended claims.

Next, the control of the correspondence of ejection data to nozzle rows in the inkjet printer 1A will be described with reference to a flowchart in FIG. 12.

Figure 12:
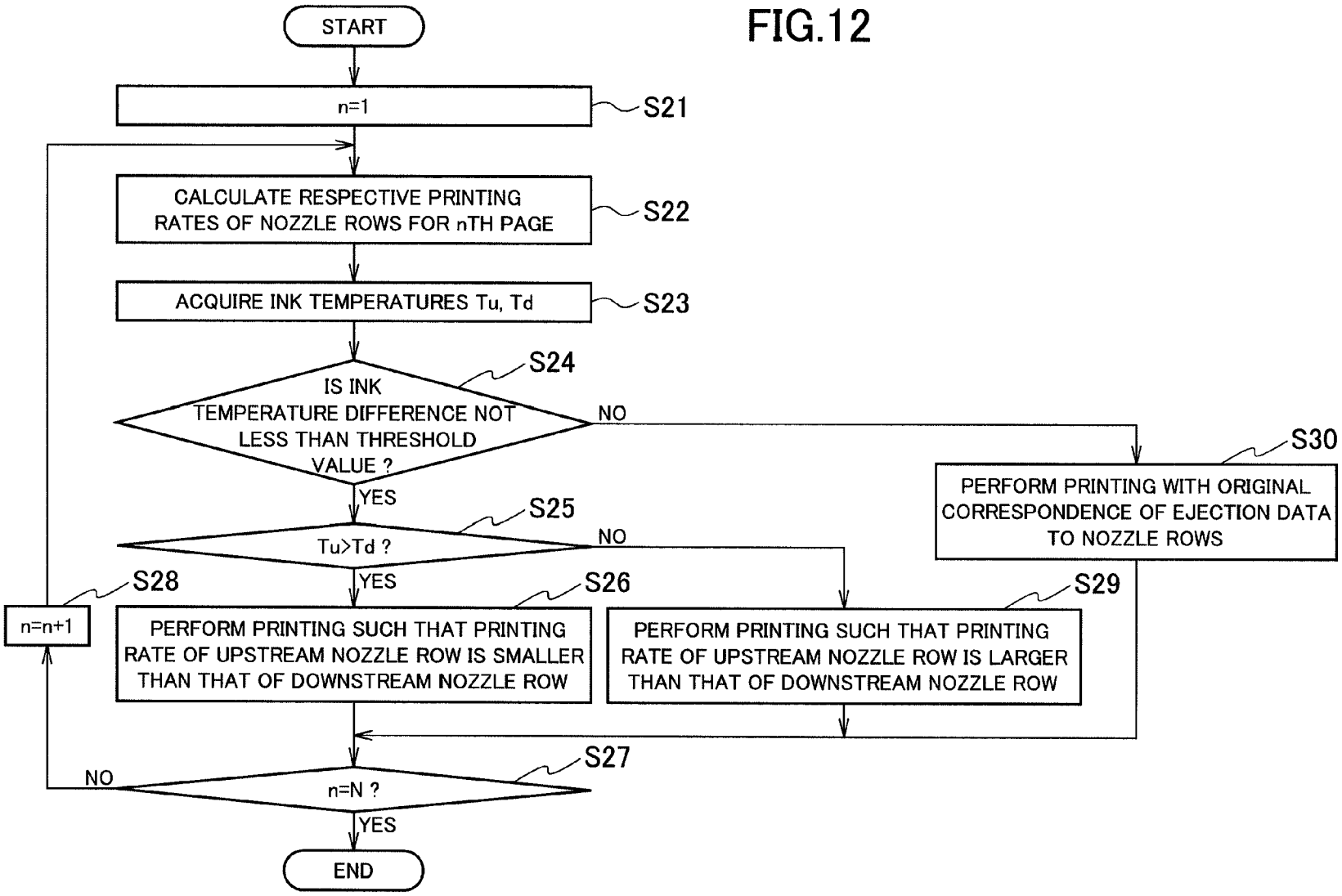
FIG. 12 is a flowchart for explaining the control of the correspondence of ejection data to the nozzle rows in the fourth embodiment.

Processing represented by the flowchart in FIG. 12 is started by the input of print data into the inkjet printer 1A.

In step S21 of FIG. 12, the controller 4 assigns "1" to a variable n, which indicates a page number.

Subsequently, in step S22, the controller 4 calculates the printing rates of the nozzle rows 12U and 12D for the nth page. Specifically, the controller 4 calculates the printing rate for the nth page in the upstream nozzle row ejection data and the printing rate for the nth page in the downstream nozzle row ejection data.

Then, in step S23, the controller 4 acquires ink temperature Tu in the region 21U of the ink chamber 11 from the temperature sensor 14U, and acquires ink temperature Td in the region 21D from the temperature sensor 14D.

After that, in step S24, the controller 4 determines whether or not the ink temperature difference |Tu−Td| between the regions 21U and 21D is not less than a threshold value.

If the controller 4 determines that the temperature difference |Tu−Td| is not less than the threshold value (step S24: YES), the controller 4 determines in step S25 whether Tu>Td is satisfied or not.

If the controller 4 determines that Tu>Td is satisfied (step S25: YES), the controller 4 prints the nth page in step S26 such that the printing rate of the upstream nozzle row 12U is smaller than the printing rate of the downstream nozzle row 12D.

Specifically, if the printing rate for the nth page in the upstream nozzle row ejection data is smaller than that in the downstream nozzle row ejection data, the controller 4 performs printing by causing the upstream nozzle row 12U to eject ink based on the upstream nozzle row ejection data and causing the downstream nozzle row 12D to eject ink based on the downstream nozzle row ejection data. On the other hand, if the printing rate for the nth page in the upstream nozzle row ejection data is larger than that in the downstream nozzle row ejection data, the controller 4 performs printing by causing the upstream nozzle row 12U to eject ink based on the downstream nozzle row ejection data and causing the downstream nozzle row 12D to eject ink based on the upstream nozzle row ejection data.

Subsequently, in step S27, the controller 4 determines whether or not the variable n is "N," which indicates a last page. If the controller 4 determines that the variable n is "N" (step S27: YES), the controller 4 terminates the processing.

If the controller 4 determines that the variable n is not "N" (step S27: NO), the controller 4 adds "1" to the variable n in step S28. After that, the controller 4 returns to step S22.

If in step S25 the controller 4 determines that Tu≤Td is satisfied (step S25: NO), the controller 4 prints the nth page in step S29 such that the printing rate of the upstream nozzle row 12U is larger than the printing rate of the downstream nozzle row 12D.

Specifically, if the printing rate for the nth page in the upstream nozzle row ejection data is larger than that in the downstream nozzle row ejection data, the controller 4 performs printing by causing the upstream nozzle row 12U to eject ink based on the upstream nozzle row ejection data and causing the downstream nozzle row 12D to eject ink based on the downstream nozzle row ejection data. On the other hand, if the printing rate for the nth page in the upstream nozzle row ejection data is smaller than that in the downstream nozzle row ejection data, the controller 4 performs printing by causing the upstream nozzle row 12U to eject ink based on the downstream nozzle row ejection data and causing the downstream nozzle row 12D to eject ink based on the upstream nozzle row ejection data. After step S29, the controller 4 goes to step S27.

If in step S24 the controller 4 determines that the ink temperature difference |Tu−Td| is less than the threshold value (step S24: NO), the controller 4 performs printing in step S30 with the original correspondence of the ejection data to the nozzle rows 12U and 12D maintained. Specifically, the controller 4 performs printing by causing the upstream nozzle row 12U to eject ink based on the upstream nozzle row ejection data and causing the downstream nozzle row 12D to eject ink based on the downstream nozzle row ejection data. After step S30, the controller 4 goes to step S27.

The above-described control of the correspondence of the ejection data to the nozzle rows 12U and 12D will be described using an example shown in FIGS. 13A to 13C.

In the example shown in FIGS. 13A to 13C, the threshold value for the ink temperature difference |Tu−Td| is assumed to be 10° C. As shown in FIG. 13A, the ink temperature difference |Tu−Td| for the kth page is 10° C., which is not less than the threshold value. Further, Tu>Td is satisfied.

Accordingly, the controller 4 prints the kth page such that the printing rate of the upstream nozzle row 12U is smaller than the printing rate of the downstream nozzle row 12D (step S26).

As shown in FIG. 13B, the printing rate (37%) for the kth page in the upstream nozzle row ejection data is larger than the printing rate (16%) for the kth page in the downstream nozzle row ejection data. Accordingly, the controller 4 reverses the correspondence of the ejection data to the nozzle rows 12U and 12D for the kth page from the correspondence in FIG. 13B.

Specifically, for the kth page, the controller 4 correlates the downstream nozzle row ejection data with the upstream nozzle row 12U, and correlates the upstream nozzle row ejection data with the downstream nozzle row 12D. Thus, as shown in FIG. 13C, for the kth page, the printing rates of the nozzle rows 12U and 12D at the time of printing are reverse to those in FIG. 13B. This reduces a further increase in the ink temperature difference between the regions 21U and 21D.

As described above, in the fourth embodiment, the controller 4 controls the correspondence of the ejection data to the nozzle rows 12U and 12D using the printing rates for each page in the upstream nozzle row ejection data and the downstream nozzle row ejection data and ink temperatures Tu and Td detected by the temperature sensors 14U and 14D. In this way, by using printing rates in ejection data and ink temperatures Tu and Td detected, the ink temperature difference between the regions 21U and 21D can be controlled with high accuracy.

(Fifth Embodiment)

Figure 14:
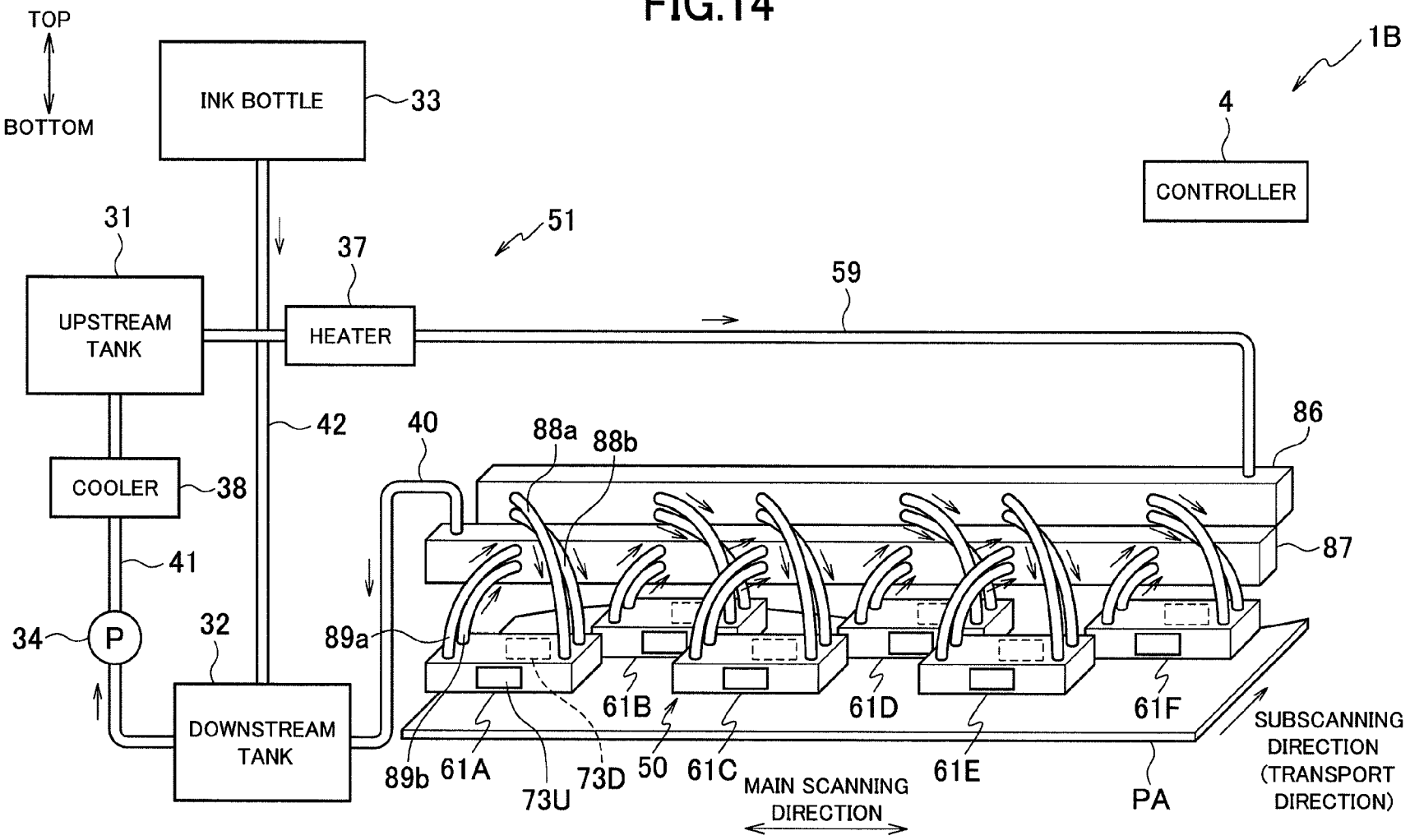
FIG. 14 is a view schematically showing the configuration of an inkjet printer according to a fifth embodiment.
Figure 15:
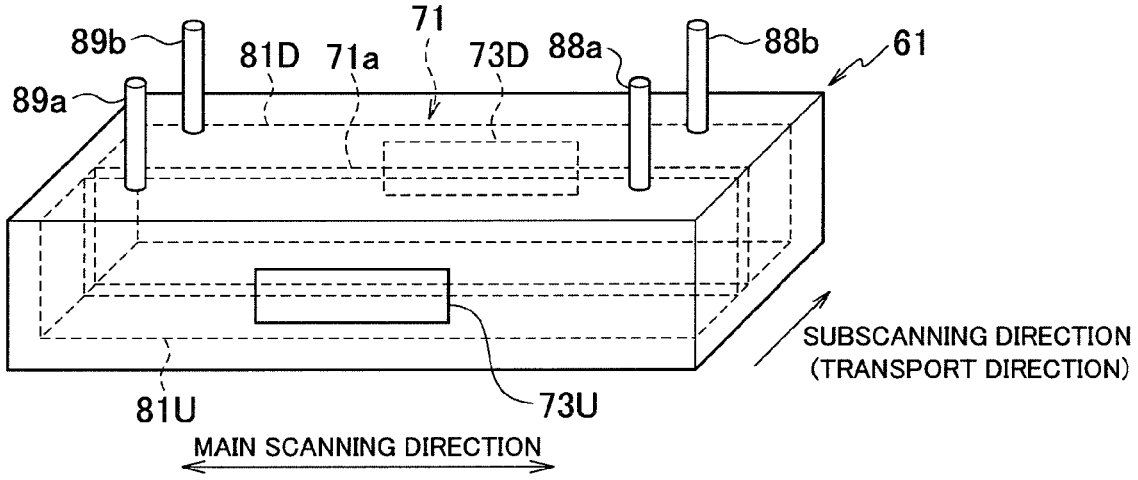
FIG. 15 is a view schematically showing the configuration of a head module of the inkjet printer shown in FIG. 14.
Figure 16:
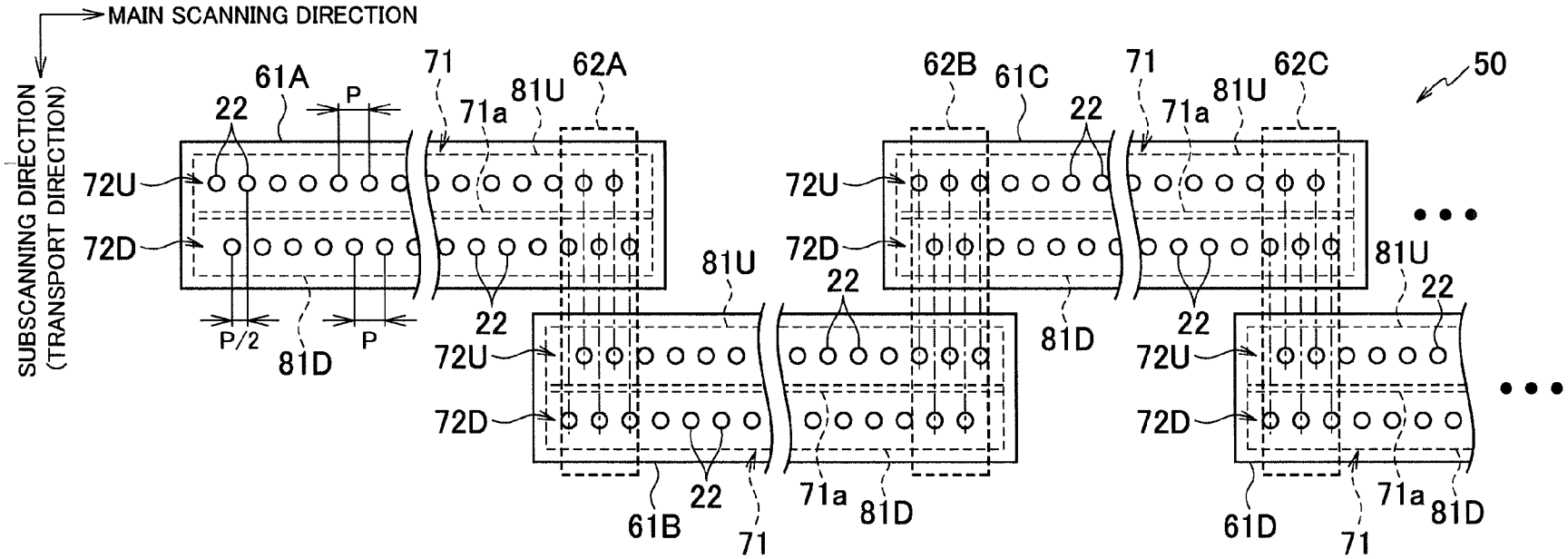
FIG. 16 is a view for explaining the arrangement and overlapping portions of head modules in the inkjet printer shown in FIG. 14.

Next, a fifth embodiment will be described. FIG. 14 is a view schematically showing the configuration of an inkjet printer according to the fifth embodiment. FIG. 15 is a view schematically showing the configuration of a head module of the inkjet printer shown in FIG. 14. FIG. 16 is a view for explaining the arrangement of and overlapping portions between head modules in the inkjet printer shown in FIG. 14.

As shown in FIG. 14, an inkjet printer 1B according to the fifth embodiment has a configuration obtained by replacing the inkjet head 2 and the ink circulation system 3 of the inkjet printer 1 of the first embodiment shown in FIG. 1 by an inkjet head 50 and an ink circulation system 51, respectively.

The inkjet head 50 includes six head modules 61A to 61F. It should be noted that the head modules 61A to 61F may be expressed in a general manner with the alphabetical suffixes (A to F) of the reference numerals thereof omitted.

The head modules 61 eject ink onto a sheet of paper PA which is being transported by an unillustrated transport system. As shown in FIGS. 14 and 16, the head modules 61A to 61F are staggered along the main scanning direction. Specifically, the six head modules 61A to 61F are arranged along the main scanning direction, and are placed on alternating sides of a line extending in the subscanning direction.

Moreover, the head modules 61A to 61F are arranged such that head modules 61 adjacent to each other in the main scanning direction partially overlap each other. Specifically, in the inkjet head 50, overlapping portions 62A to 62E are formed in which head modules 61 adjacent to each other in the main scanning direction overlap each other.

The overlapping portion 62A is a place where the head modules 61A and 61B overlap each other. The overlapping portion 62B is a place where the head modules 61B and 61C overlap each other. The overlapping portion 62C is a place where the head modules 61C and 61D overlap each other. The overlapping portion 62D is a place where the head modules 61D and 61E overlap each other (see FIG. 21). The overlapping portion 62E is a place where the head modules 61E and 61F overlap each other (see FIG. 21). It should be noted that the overlapping portions 62A to 62E may be expressed in a general manner with the alphabetical suffixes (A to E) of the reference numerals thereof omitted.

As shown in FIGS. 15 and 16, the head module 61 includes an ink chamber 71, two nozzle rows 72U and 72D, and drivers 73U and 73D.

The ink chamber 71 stores ink supplied from the ink circulation system 51. In the ink chamber 71, a partition 71*a* is provided. The partition 71*a* partitions the inside of the ink chamber 71 into an upstream region 81U and a downstream region 81D.

The regions 81U and 81D store ink of the same color supplied from the conduit 39 and distributed by an ink distributor 86. In the regions 81U and 81D, piezoelectric elements (not shown) are disposed. The upstream region 81U corresponds to the first region (or second region) described in the appended claims. The downstream region 81D corresponds to the second region (or first region) described in the appended claims.

Each of the nozzle rows 72U and 72D includes multiple nozzles 22 as shown in FIG. 16. The nozzle rows 72U and 72D are disposed to be spaced apart from each other in the transport direction of the sheet of paper PA. The upstream nozzle row 72U corresponds to the first nozzle row (or second nozzle row) described in the appended claims. The downstream nozzle row 72D corresponds to the second nozzle row (or first nozzle row) described in the appended claims.

The nozzles 22 have openings at the bottom of the head module 61. The nozzles 22 in the upstream nozzle row 72U eject ink stored in the upstream region 81U of the ink chamber 71. The nozzles 22 in the downstream nozzle row 72D eject ink stored in the downstream region 81D of the ink chamber 71.

In each of the nozzle rows 72U and 72D, the nozzles 22 are arranged along the main scanning direction and equally spaced with a predetermined pitch P. Moreover, the nozzles 22 in the nozzle row 72U and the nozzles 22 in the nozzle row 72D are shifted from each other by half of the pitch (P/2) in the main scanning direction. Further, in the overlapping portions 62, as shown in FIG. 16, corresponding nozzles 22 in the nozzle rows 72U are arranged in a line along the main scanning direction, and corresponding nozzles 22 in the nozzle rows 72D are arranged in a line along the main scanning direction.

The drivers 73U and 73D drive the piezoelectric elements (not shown) disposed in the regions 81U and 81D to cause the nozzles 22 in the nozzle rows 72U and 72D to eject ink, respectively.

The ink circulation system 51 has a configuration obtained by replacing the ink distributor 35, the collector 36, and the conduits 43*a*, 43*b*, 44*a*, and 44*b* of the ink circulation system 3 of the inkjet printer 1 shown in FIG. 1 by an ink distributor 86, a collector 87, and conduits 88*a*, 88*b*, 89*a*, and 89*b*.

The ink distributor 86 distributes ink supplied from the upstream tank 31 through the conduit 39 to the regions 81U and 81D of the ink chambers 71 of the head modules 61A to 61F.

The collector 87 collects ink not consumed by the head modules 61A to 61F in ejection operation from the regions 81U and 81D of the ink chambers 71. The ink collected by the collector 87 flows into the downstream tank 32 through the conduit 40.

The conduit 88*a* connects the ink distributor 86 and the upstream region 81U of the ink chamber 71 of the head module 61. The conduit 88*b* connects the ink distributor 86 and the downstream region 81D of the ink chamber 71 of the head module 61. The conduit 89*a* connects the upstream region 81U of the ink chamber 71 of the head module 61 and the collector 87. The conduit 89*b* connects the downstream region 81D of the ink chamber 71 of the head module 61 and the collector 87. The conduits 88*a*, 88*b*, 89*a*, and 89*b* are provided in each of the head module 61.

At the time of printing, the controller 4 performs control based on upstream nozzle row ejection data and downstream nozzle row ejection data so that the nozzles 22 in the nozzle rows 72U and 72D of the head modules 61A to 61F may eject ink line by line to perform printing.

The controller 4 performs printing while controlling the correspondence of the ejection data to the nozzle rows 72U and 72D for each of the head modules 61 so that the ink temperature difference between the regions 81U and 81D caused by ink ejection operations may be smaller than that in the case where printing is performed with the correspondence of the ejection data to the nozzle rows 72U and 72D fixed. In other words, the controller 4 performs printing while controlling the correspondence of the upstream nozzle row ejection data and the downstream nozzle row ejection data to the nozzle rows 72U and 72D in each head module 61 so that an increase in the ink temperature difference between the regions 81U and 81D caused by ink ejection operations in each head module 61 may be reduced.

Specifically, the controller 4 controls the correspondence of the ejection data to the nozzle rows 72U and 72D in each head module 61 so that the relation of inequality between the printing rates of the nozzle rows 72U and 72D for the previous page may be reverse to the relation of inequality between the printing rates of the nozzle rows 72U and 72D for the current page.

It should be noted, however, that in the printing of each page, in the case where the overlapping portions 62A to 62E include one or more overlapping portions 62 without continuous non-ejection regions described later, the controller 4 controls a cooperative head module group consisting of head modules 61 continuous with each other with the overlapping portion(s) 62 without continuous non-ejection regions interposed therebetween such that the correspondences of the ejection data to the nozzle rows 72U and 72D in the head modules 61 of the cooperative head module group are controlled in conjunction with each other.

Specifically, the controller 4 selects a reference head module from the cooperative head module group. At this time, the controller 4 selects the reference head module using the sum of cumulative printing rates of the nozzle rows 72U and 72D in each head module 61 of the cooperative head module group.

Further, the controller 4 controls the correspondence of the ejection data to the nozzle rows 72U and 72D in the reference head module so that the relation of inequality between the printing rates of the nozzle rows 72U and 72D for the previous page may be reverse to the relation of inequality between the printing rates of the nozzle rows 72U and 72D for the current page in the reference head module. At this time, the controller 4 also controls the respective correspondence(s) between the ejection data and the nozzle rows 72U and 72D in the other head module(s) 61 of the cooperative head module group in conjunction with that in the reference head module.

A description will now be made of a reason for controlling the respective correspondences of the ejection data to the nozzle rows 72U and 72D in the head modules 61 of the cooperative head module group in conjunction with each other as described above.

As in the first embodiment described with reference to FIGS. 3 and 4, in the inkjet printer 1B, if the correspondence of the ejection data to the nozzle rows 72U and 72D is reversed, a printed image similar to that formed in the case of the original correspondence is formed. It should be noted, however, that the printed image is shifted in the main scanning direction by half of the pitch (P/2). Accordingly, in the inkjet printer 1B, in the case where the correspondences of the ejection data to the nozzle rows 72U and 72D are reverse to each other between adjacent head modules 61, the degradation of print quality may occur in the overlapping portions 62.

Figure 17:
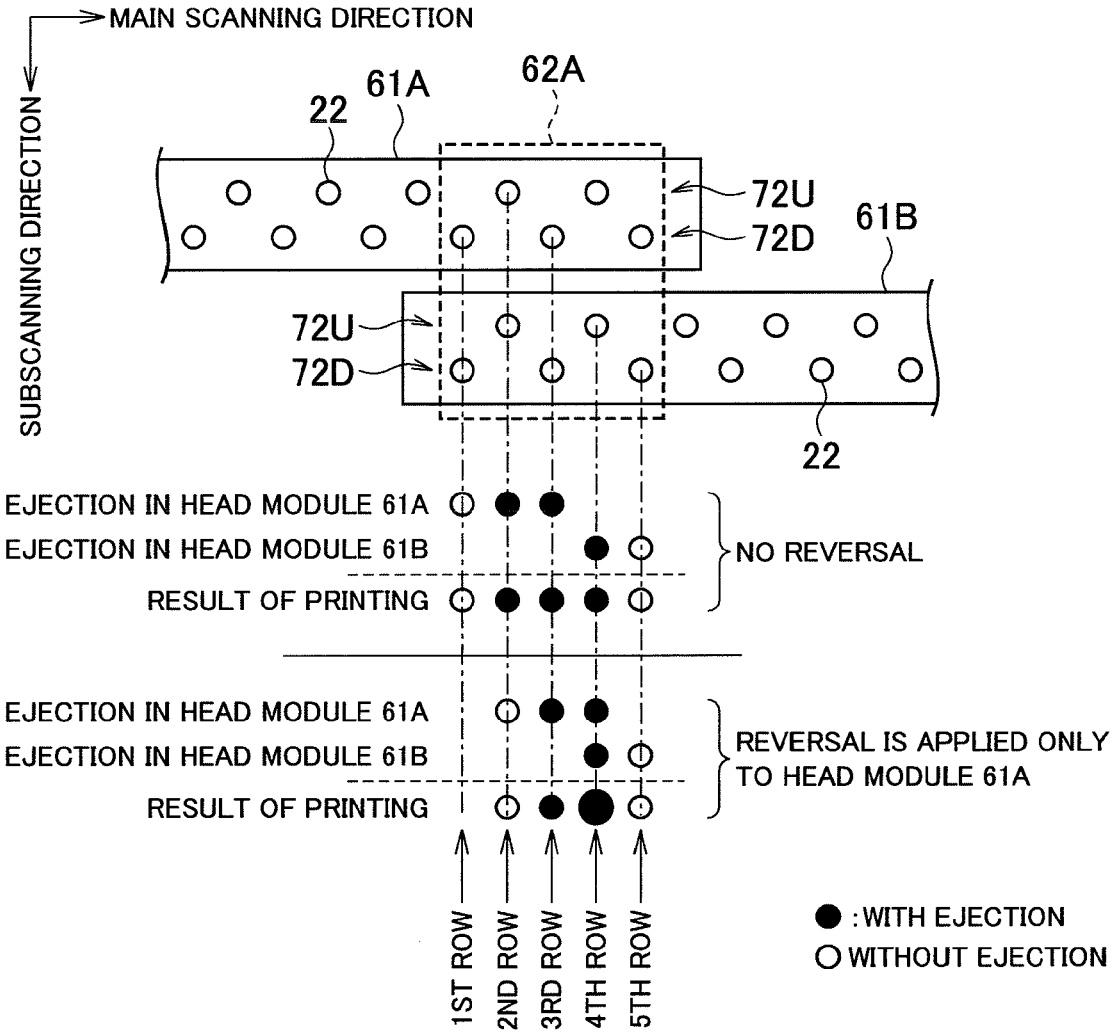
FIG. 17 is a view for explaining ink ejection in an overlapping portion.

For example, ink ejection such as shown in FIG. 17 is assumed to be performed in the overlapping portion 62A. In the case where printing is performed with the original correspondence of the ejection data to the nozzle rows 72U and 72D (no reversal), the nozzles 22 to be used are selected so that ink may not be ejected from two head modules 61 onto the same position with respect to the main scanning direction in an overlapping manner. In the example of FIG. 17, among five rows which perform printing in the overlapping portion 62A, ink is ejected from the head module 61A onto the first to third rows from the left in the drawing, and ink is ejected from the head module 61B onto the fourth and fifth rows.

In that case, reversing the correspondence of the ejection data to the nozzle rows 72U and 72D only in the head module 61A causes only an ejection pattern of the head module 61A to be shifted. For example, as shown in FIG. 17, the ejection pattern of the head module 61A is shifted to the right in the drawing by half of the pitch, and an ejection pattern of the head module 61B is not shifted. In that case, both of the head modules 61A and 61B eject ink onto the fourth row. Accordingly, in the result of printing in the fourth row, larger dots are formed than in the case where the correspondence of the ejection data to the nozzle rows 72U and 72D is not reversed. As a result, print quality degrades.

Figure 18:
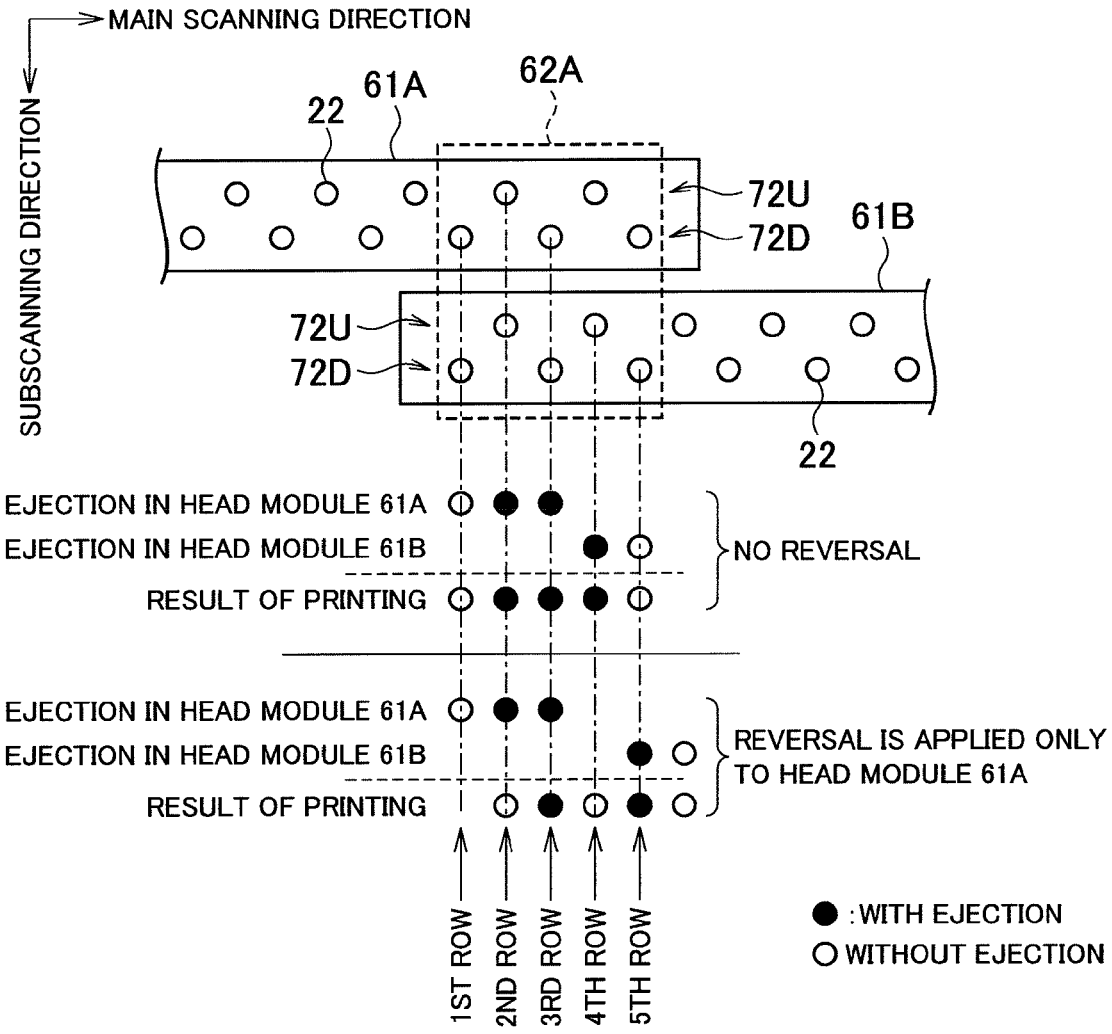
FIG. 18 is a view for explaining ink ejection in the overlapping portion.

The assumption is now made that, for example, the correspondence of the ejection data to the nozzle rows 72U and 72D is reversed only in the head module 61B. In that case, only the ejection pattern of the head module 61B is shifted. For example, as shown in FIG. 18, the ejection pattern of the head module 61B is shifted to the right in the drawing by half of the pitch, and the ejection pattern of the head module 61A is not shifted. In that case, neither of the head modules 61A and 61B ejects ink onto the fourth row.

Accordingly, in a portion from third to fifth rows formed in the case where reversal is performed, which corresponds to a continuous ejected portion from second to fourth rows formed in the case of no reversal, ink is not ejected onto the fourth row. As a result, print quality degrades.

As shown in FIGS. 17 and 18, when the correspondence of the ejection data to the nozzle rows 72U and 72D is reversed in only one of two adjacent head modules 61, the degradation of print quality may occur.

It should be noted, however, that in the case where the overlapping portion 62 has a continuous non-ejection region, the degradation of print quality such as described above is small. A continuous non-ejection region is a region including several nozzles continuous in the main scanning direction which would not eject ink in printing performed with the original correspondence of the ejection data to the nozzle rows 72U and 72D (no reversal).

Figure 19:
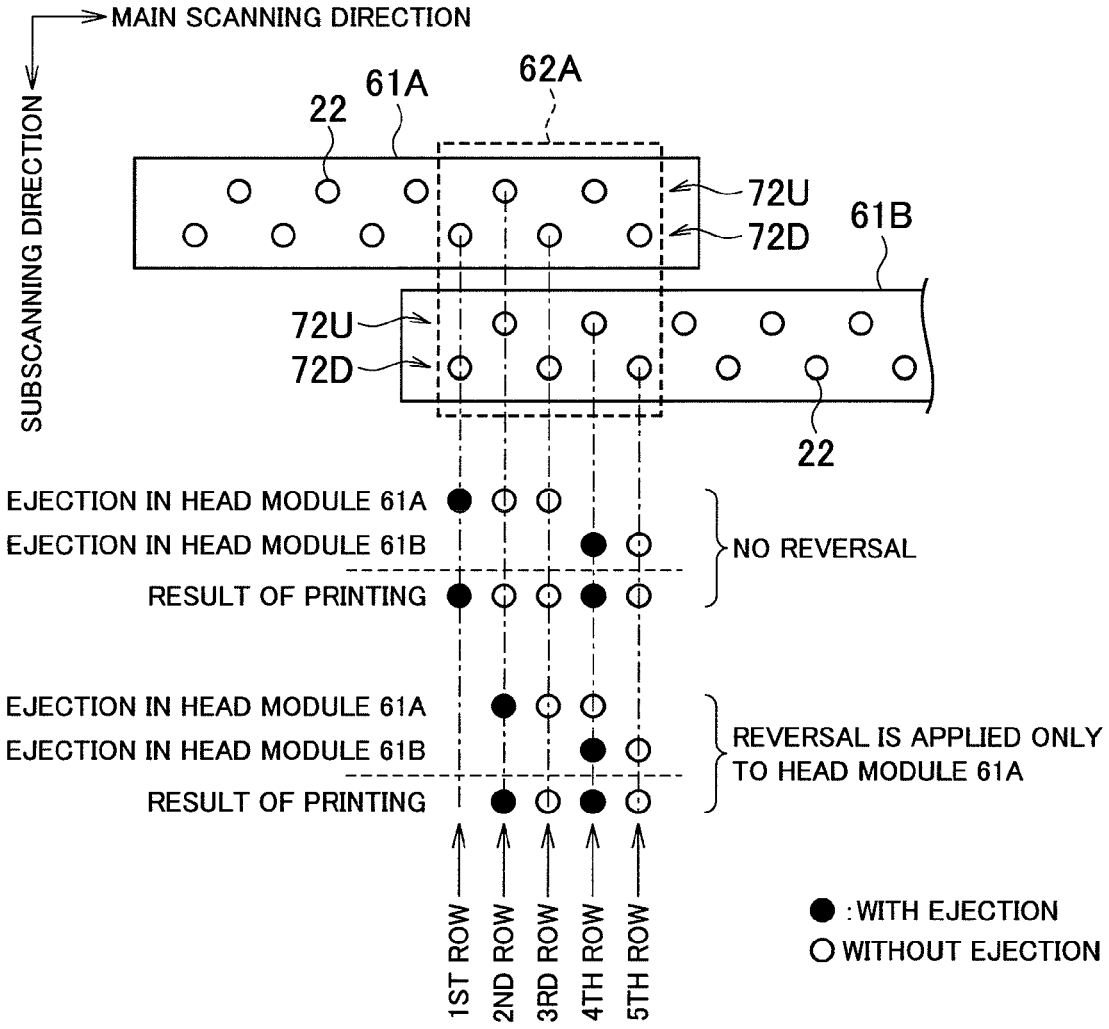
FIG. 19 is a view for explaining ink ejection in the overlapping portion.

For example, as shown in FIG. 19, it is assumed that ink is not ejected onto the second and third rows (no ejection) in the case where printing is performed without reversing the correspondence of the ejection data to the nozzle rows 72U and 72D. This portion corresponds to the continuous non-ejection region. Moreover, the head module 61A ejects ink onto the first row, and the head module 61B ejects ink onto the fourth row.

The assumption is now made that only the ejection pattern of the head module 61A is shifted to the right in the drawing by half of the pitch by reversing the correspondence of the ejection data to the nozzle rows 72U and 72D only in the head module 61A. In that case, as shown in FIG. 19, while printing with no reversal produces a result of printing in which ink is not ejected onto two rows in the second and third rows, printing with reversal produces a result of printing in which there is only one no-ejection row in the third row. In other words, the number of no-ejection rows decreases by one.

Moreover, in the example of FIG. 19, in the case where the correspondence of the ejection data to the nozzle rows 72U and 72D is reversed only in the head module 61B, there are three no-ejection rows in the second to fourth rows. In other words, the number of no-ejection rows increases by one.

However, a one-row increase or decrease in the number of no-ejection rows is a change which cannot be recognized by human eyes, and the degradation of print quality is negligible.

Moreover, in the case where there is a continuous non-ejection region, a reversal of the correspondence of the ejection data to the nozzle rows 72U and 72D in only one of the head modules 61 highly-possibly results in avoidance of an ejection overlap as shown in FIG. 17.

As described above, in the case where there is a continuous non-ejection region in an overlapping portion 62, even when the correspondence of the ejection data to the nozzle rows 72U and 72D is different between two head modules 61 adjacent to each other across the overlapping portion 62, the influence of the difference on print quality is small. On the other hand, in the case where there is no continuous non-ejection region in an overlapping portion 62, when the correspondence of the ejection data to the nozzle rows 72U and 72D is different between two head modules 61 adjacent to each other across the overlapping portion 62, print quality degrades as in the examples in FIGS. 17 and 18.

Accordingly, as described previously, the controller 4 controls a cooperative head module group consisting of head modules 61 continuous with each other across an overlapping portion or portions 62 without continuous non-ejection regions such that the respective correspondences of the ejection data to the nozzle rows 72U and 72D in the head modules 61 of the cooperative head module group are controlled in conjunction with each other. On the other hand, for head modules 61 adjacent to each other across an overlapping portion 62 with a continuous non-ejection region, the controller 4 controls the correspondences of the ejection data to the nozzle rows 72U and 72D separately.

Next, the operation of the inkjet printer 1B will be described.

Figure 20:
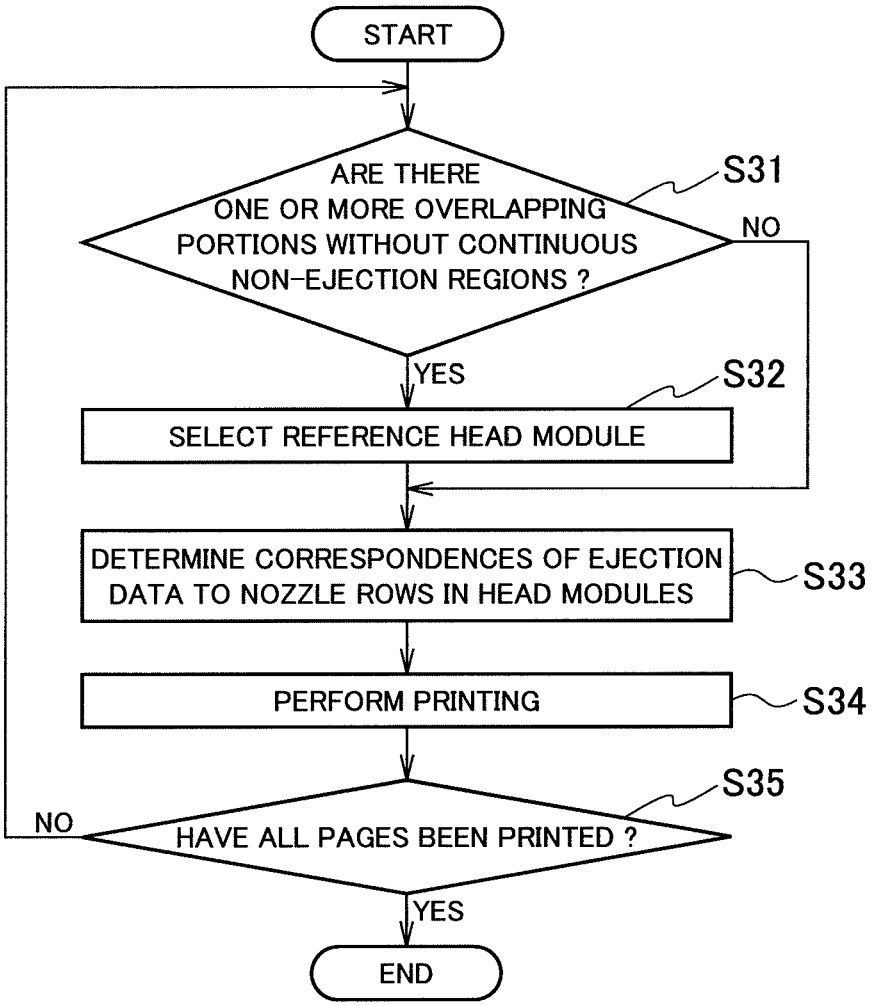
FIG. 20 is a flowchart for explaining the operation of the inkjet printer according to the fifth embodiment.

FIG. 20 is a flowchart for explaining the operation of the inkjet printer 1B. Processing represented by the flowchart in FIG. 20 is started by the input of print data into the inkjet printer 1B. The print data contains upstream nozzle row ejection data and downstream nozzle row ejection data.

In step S31 of FIG. 20, based on ejection data for a page to be printed, the controller 4 determines whether or not there are one or more overlapping portions 62 without continuous non-ejection regions in the printing of the current page.

If the controller 4 determines that there are one or more overlapping portions 62 without continuous non-ejection regions (step S31: YES), the controller 4 selects a reference head module from the cooperative head module group in step S32.

Figure 21:
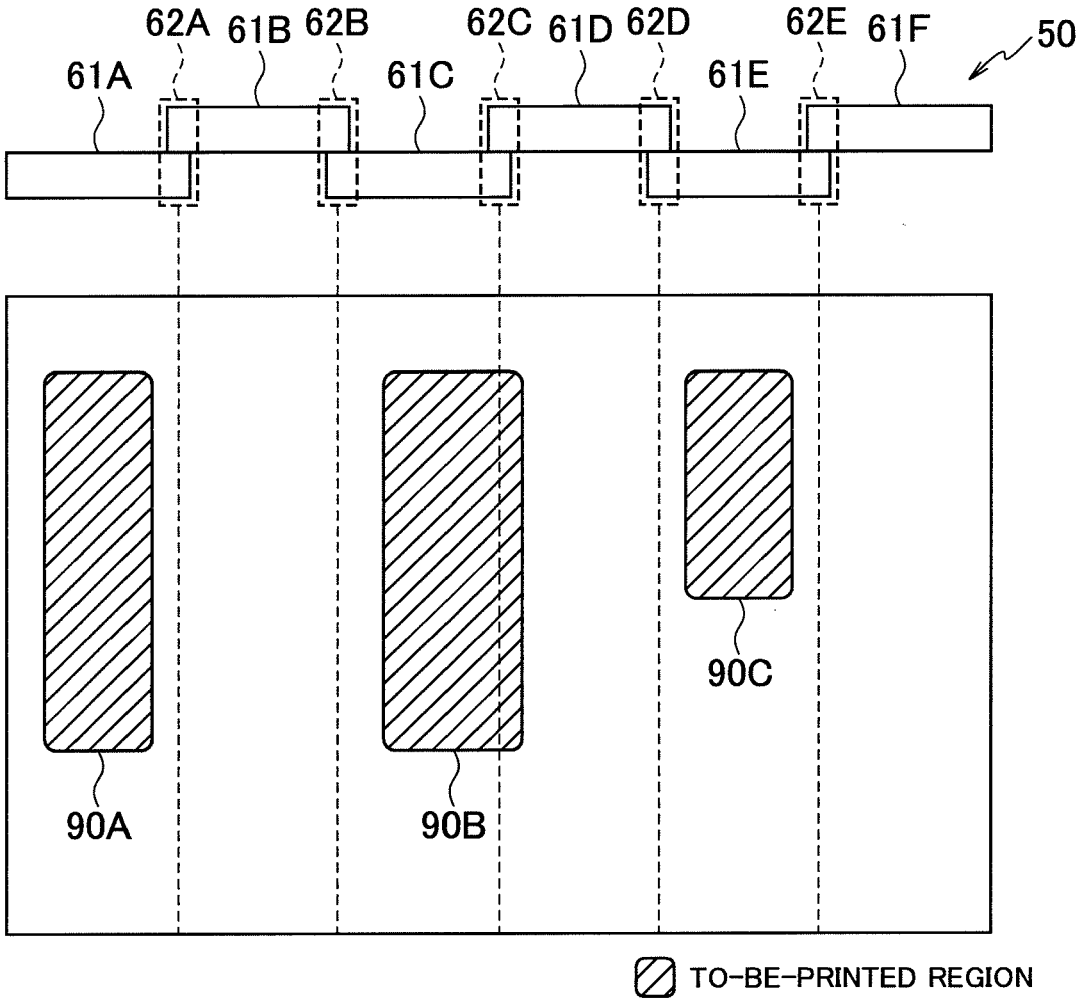
FIG. 21 is a conceptual drawing of an image which has continuous non-ejection regions.

The assumption is now made that, for example, the overlapping portion 62C has no continuous non-ejection region for a page having to-be-printed regions 90A to 90C as shown in FIG. 21. In that case, the head modules 61C and 61D continuous with each other across the overlapping portion 62C without a continuous non-ejection region constitute a cooperative head module group. Accordingly, in this case, the controller 4 selects a reference head module from the head modules 61C and 61D. Procedures for selecting the reference head module will be described later.

It should be noted that for example, in the case where the overlapping portion 62C and the overlapping portion 62E have no continuous non-ejection regions, the head modules 61C and 61D constitute one cooperative head module group, and the head modules 61E and 61F constitute another cooperative head module group. In another example, in the case where the overlapping portion 62C and the overlapping portion 62D have no continuous non-ejection regions, the head modules 61C, 61D, and 61E constitute a cooperative head module group.

Subsequently, in step S33, the controller 4 determines the correspondence of the ejection data to the nozzle rows 72U and 72D in each head module 61.

Specifically, for each head module 61 not included in a cooperative head module group, the controller 4 determines the correspondence of the ejection data to the nozzle rows 72U and 72D so that the relation of inequality between the printing rates of the nozzle rows 72U and 72D for the previous page may be reverse to the relation of inequality between the printing rates of the nozzle rows 72U and 72D for the current page in the head module 61.

It should be noted that in the case where the current printing is the printing of the first page, the original correspondence of the ejection data to the nozzle rows 72U and 72D is selected. Specifically, the correspondence is determined so that the upstream nozzle row 72U is caused to eject ink based on the upstream nozzle row ejection data and that the downstream nozzle row 72D is caused to eject ink based on the downstream nozzle row ejection data.

For a cooperative head module group, the controller 4 determines the correspondence of the ejection data to the nozzle rows 72U and 72D in the reference head module so that the relation of inequality between the printing rates of the nozzle rows 72U and 72D for the previous page may be reverse to the relation of inequality between the printing rates of the nozzle rows 72U and 72D for the current page in the reference head module. At this time, the controller 4 also controls the respective correspondence(s) between the ejection data and the nozzle rows 72U and 72D in the other head module(s) 61 of the cooperative head module group in conjunction with that in the reference head module.

For example, the assumption is made that the correspondence of the ejection data to the nozzle rows 72U and 72D in the reference head module is determined to be reversed from the original one. Specifically, it is assumed that the correspondence is determined so that in the reference head module, the downstream nozzle row 72D may be caused to eject ink based on the upstream nozzle row ejection data, and the upstream nozzle row 72U may be caused to eject ink based on the downstream nozzle row ejection data. In that case, for the other head module(s) of the cooperative head module group, the controller 4 also determines the correspondence of the ejection data to the nozzle rows 72U and 72D to be reversed from the original one.

If in step S31 the controller 4 determines that there is no overlapping portion 62 without a continuous non-ejection region, that is, all the overlapping portions 62 have continuous non-ejection regions (step S31: NO), the controller 4 determines the correspondence of the ejection data to the nozzle rows 72U and 72D in each head module 61 in step S33.

Specifically, for each head module 61, the controller 4 determines the correspondence of the ejection data to the nozzle rows 72U and 72D so that the relation of inequality between the printing rates of the nozzle rows 72U and 72D for the previous page may be reverse to the relation of inequality between the printing rates of the nozzle rows 72U and 72D for the current page in the head module 61.

After step S33, in step S34, the controller 4 carries out printing. Specifically, the controller 4 causes the nozzle rows 72U and 72D of each head module 61 to eject ink based on the upstream nozzle row ejection data and the downstream nozzle row ejection data while causing an unillustrated transport system to transport a sheet of paper PA. The controller 4 causes the nozzles 22 in the nozzle rows 72U and 72D to eject ink in accordance with the correspondence of the ejection data to the nozzle rows 72U and 72D in each head module determined in step S33. Thus, an image is printed onto a sheet of paper PA.

Subsequently, in step S35, the controller 4 determines whether all pages have been printed or not. If the controller 4 determines that not all pages have been printed (step S35: NO), the controller 4 returns to step S31. If the controller 4 determines that all pages have been printed (step S35: YES), the controller 4 terminates processing.

Next, an explanation of the above-described procedures for selecting a reference head module in step S32 of FIG. 20 will be made with reference to the flowchart in FIG. 22.

Figure 22:
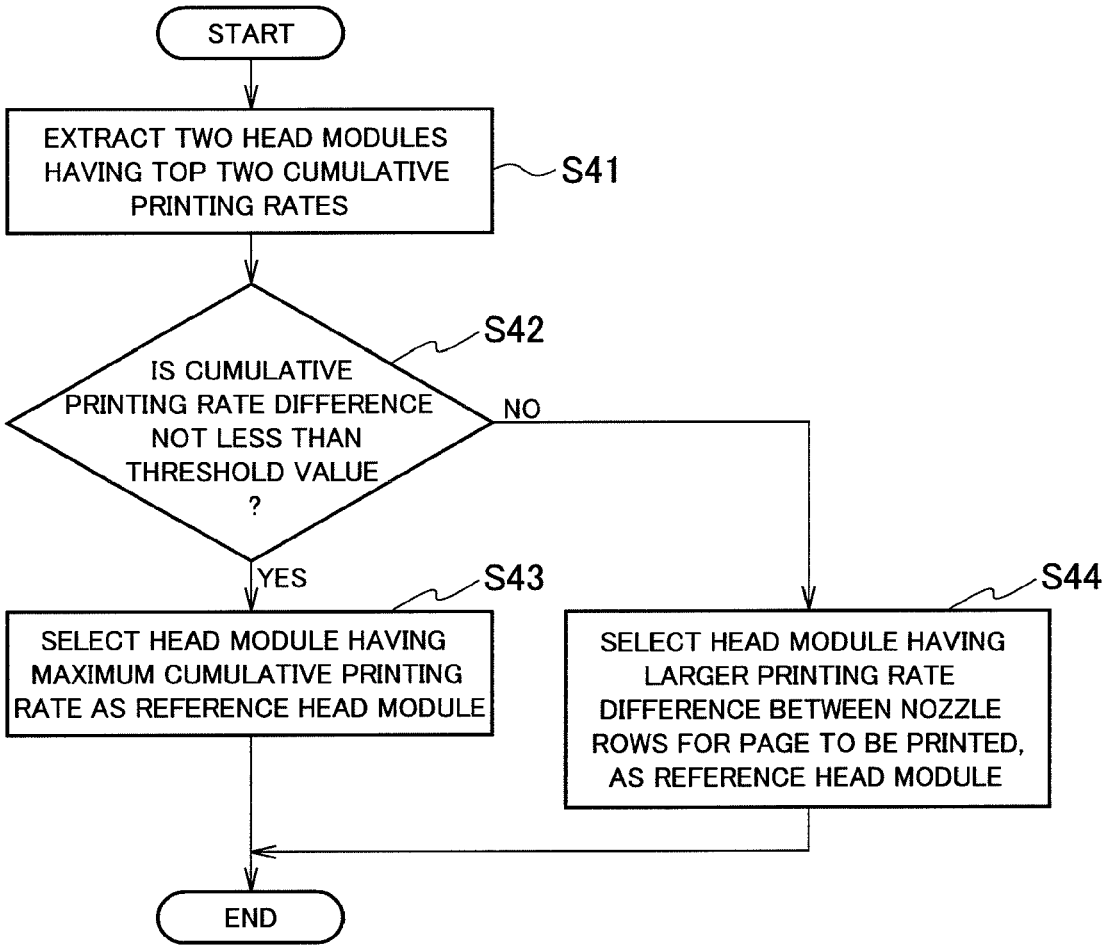
FIG. 22 is a flowchart showing procedures for selecting a reference head module.

In step S41 of FIG. 22, the controller 4 extracts two head modules 61 having top two cumulative printing rates from the head modules 61 included in a cooperative head module group. The cumulative printing rates in a head module 61 is the sum of the cumulative printing rates of the nozzle rows 72U and 72D from the start of printing.

Subsequently, in step S42, the controller 4 determines whether or not the difference between the cumulative printing rates in the two head modules extracted in step S41 is not less than a threshold value.

If the controller 4 determines that the cumulative printing rate difference is not less than the threshold value (step S42: YES), the controller 4 selects the head module 61 having a maximum cumulative printing rate as a reference head module in step S43.

If in step S42 the controller 4 determines that the cumulative printing rate difference is less than the threshold value (step S42: NO), the controller 4 selects in step S44 one head module 61 of the two head modules 61 extracted in step S41 which has a larger printing rate difference between the nozzle rows 72U and 72D for a page to be currently printed, as a reference head module.

For example, the following assumptions are made: a cumulative printing rate for each page in each head module 61 is such as shown in FIG. 23; for the fourth page, the overlapping portion 62C between the head modules 61C and 61D does not include a continuous non-ejection region, that is, the head modules 61C and 61D constitute a cooperative head module group; for the sixth page, the overlapping portion 62E between the head modules 61E and 61F does not include a continuous non-ejection region, that is, the head modules 61E and 61F constitute a cooperative head module group; for the eighth page, the overlapping portion 62A between the head modules 61A and 61B does not include a continuous non-ejection region, that is, the head modules 61A and 61B constitute a cooperative head module group; and, the threshold value for the cumulative printing rate difference is 5(%).

For the fourth page, the difference between the cumulative printing rate of 80(%) in the head module 61C and the cumulative printing rate of 50(%) in the head module 61D to the previous page (third page) is not less than the threshold value of 5(%). Further, the cumulative printing rate in the head module 61C is larger than that in the head module 61D. Accordingly, the head module 61C is selected as a reference head module.

For the sixth page, the difference between the cumulative printing rate of 87(%) in the head module 61E and the cumulative printing rate of 100(%) in the head module 61F to the previous page (fifth page) is not less than the threshold value of 5(%). Further, the cumulative printing rate in the head module 61F is larger than that in the head module 61E. Accordingly, the head module 61F is selected as a reference head module.

For the eighth page, the difference between the cumulative printing rate of 155(%) in the head module 61A and the cumulative printing rate of 139(%) in the head module 61B to the previous page (seventh page) is not less than the threshold value of 5(%). Further, the cumulative printing rate in the head module 61A is larger than that in the head module 61B. Accordingly, the head module 61A is selected as a reference head module.

Moreover, it is assumed that for an unillustrated ninth page, the head modules 61A and 61B constitute a cooperative head module group. In that case, the difference between the cumulative printing rate of 177(%) in the head module 61A and the cumulative printing rate of 176(%) in the head module 61B to the previous page (eighth page) is less than the threshold value of 5(%).

In that case, for the ninth page, the printing rate difference between the nozzle rows 72U and 72D in the head module 61A is compared with the printing rate difference between the nozzle rows 72U and 72D in the head module 61B. For example, the following assumption is made: for the ninth page, the printing rate difference between the nozzle rows 72U and 72D in the head module 61A is 5(%), and the printing rate difference between the nozzle rows 72U and 72D in the head module 61B is 20(%). In that case, the head module 61B having a larger printing rate difference between the nozzle rows 72U and 72D is selected as a reference head module.

In the case where printing is performed with the correspondence of the ejection data to the nozzle rows 72U and 72D fixed unlike the above-described control of the correspondence of the ejection data to the nozzle rows 72U and 72D, an ink temperature difference between the regions 81U and 81D may be caused by the printing rate difference between the nozzle rows 72U and 72D.

For example, the following assumption is made: a large number of pages each having a large printing rate difference between the nozzle rows 72U and 72D are continuously printed. In that case, as shown in FIG. 5, as continuous printing time increases, the ink temperature difference between the upstream region 81U and the downstream region 81D increases. Thus, the temperature of ink in the upstream region 81U may exceed the maximum temperature T2 of the proper temperature range (T1 to T2). When the temperature of ink in the upstream region 81U exceeds the maximum temperature T2, for example, the flight of ink ejected from the upstream nozzle row 72U becomes unstable, and print quality may be degraded.

On the other hand, in the case where control is performed as described previously so that the relation of inequality between the printing rates of the nozzle rows 72U and 72D for the previous page may be reverse to the relation of inequality between the printing rates of the nozzle rows 72U and 72D for the current page, printing rates can be distributed between the nozzle rows 72U and 72D. This makes the ink temperature difference between the upstream region 81U and the downstream region 81D negligible as shown in FIG. 6. Even at a continuous printing time A at which the temperature of ink in the upstream region 81U exceeds the maximum temperature T2 in FIG. 5, the ink temperatures in the upstream region 81U and the downstream region 81D are maintained within the proper temperature range.

As described above, in the inkjet printer 1B, the controller 4 performs printing while controlling the correspondence of the upstream nozzle row ejection data and the downstream nozzle row ejection data to the nozzle rows 72U and 72D for each head module 61 so that the ink temperature difference between the regions 81U and 81D caused by ink ejection operations may be smaller than that in the case where printing is performed with the correspondence of the ejection data to the nozzle rows 72U and 72D fixed.

Specifically, for each head module 61, the controller 4 controls the correspondence of the ejection data to the nozzle rows 72U and 72D so that the relation of inequality between the printing rates of the nozzle rows 72U and 72D for the previous page may be reverse to the relation of inequality between the printing rates of the nozzle rows 72U and 72D for the current page.

The above-described control prevents a large ink temperature difference between the regions 81U and 81D in each head module 61 and reduces an ink temperature deviation from the proper temperature range. This can alleviate the reduction in the time during which printing can be performed at ink temperatures within the proper temperature range. As a result, the degradation of print quality caused by an ink temperature deviation from the proper temperature range can be alleviated.

Moreover, in the printing of each page, in the case where the overlapping portions 62A to 62E include one or more overlapping portions 62 without continuous non-ejection regions, the controller 4 controls the respective correspondences of the ejection data to the nozzle rows 72U and 72D in the head modules 61 of each cooperative head module group in conjunction with each other.

Specifically, the controller 4 selects one reference head module from the cooperative head module group. Further, the controller 4 controls the correspondence of the ejection data to the nozzle rows 72U and 72D in the reference head module so that the relation of inequality between the printing rates of the nozzle rows 72U and 72D for the previous page may be reverse to the relation of inequality between the printing rates of the nozzle rows 72U and 72D for the current page in the reference head module. At this time, the controller 4 also controls the respective correspondences of the ejection data to the nozzle rows 72U and 72D in the other head module(s) 61 of the cooperative head module group in conjunction with that in the reference head module.

The above-described control can alleviate the degradation of print quality in the overlapping portions caused by the correspondences of the ejection data to the nozzle rows 72U and 72D which are reverse to each other between adjacent head modules 61. Accordingly, in the inkjet printer 1B, it is possible to alleviate the degradation of print quality caused by an ink temperature deviation from the proper temperature range while alleviating the degradation of print quality in the overlapping portions 62.

Moreover, in the inkjet printer 1B, the ink temperature difference occurring between the regions 81U and 81D can be efficiently reduced using printing rates having large influences on ink temperature.

Moreover, in the inkjet printer 1B, the controller 4 selects a reference head module from a cooperative head module group using cumulative printing rates. In the cooperative head module group, the respective correspondences of the ejection data to the nozzle rows 72U and 72D in the other head module(s) 61 than the reference head module are controlled in conjunction with that in the reference head module. Accordingly, in each of the other head module(s) 61 than the reference head module, the relations of inequality between the printing rates of the nozzle rows 72U and 72D are not necessarily reverse to each other between adjacent pages. Thus, in the other head module(s) 61 than the reference head module, the ink temperature difference between the regions 81U and 81D may increase, and the temperature of ink in one of the regions 81U and 81D may rise close to the maximum temperature of the proper temperature range. Accordingly, in the cooperative head module group, it is appropriate that the head module 61 having a highest ink temperature is selected as a reference head module. In the inkjet printer 1B, since cumulative printing rates having large influences on ink temperature are used, a reference head module appropriate for a reference can be easily selected.

It should be noted that though in the above-described embodiment, the correspondence of the ejection data to the nozzle rows 72U and 72D is controlled so that the relation of inequality between the printing rates of the nozzle rows 72U and 72D for the previous page may be reverse to the relation of inequality between the printing rates of the nozzle rows 72U and 72D for the current page, the respective cumulative printing rates of the nozzle rows 72U and 72D to the previous page may be used instead of the printing rates of the nozzle rows 72U and 72D for the previous page.

Specifically, the correspondence of the ejection data to the nozzle rows 72U and 72D may be controlled so that the relation of inequality between the respective cumulative printing rates of the nozzle rows 72U and 72D to the previous page may be reverse to the relation of inequality between the printing rates of the nozzle rows 72U and 72D for the current page.

An explanation of the control of the correspondence of the ejection data to the nozzle rows 72U and 72D in that case will be made with reference to an example shown in FIGS. 24A to 24C.

FIG. 24A shows as an example a set of cumulative printing rates of the nozzle rows 72U and 72D to the previous page (third page) in each head module 61. FIG. 24B shows as an example a set of printing rates in upstream nozzle row ejection data and downstream nozzle row ejection data for the current page (fourth page) in each head module 61. FIG. 24C shows printing rates for the current page which are obtained after a reversing operation is performed so that the relation of inequality between the printing rates of the nozzle rows 72U and 72D for the current page may be reverse to the relation of inequality between the respective cumulative printing rates of the nozzle rows 72U and 72D to the previous page.

Moreover, it is assumed that for the fourth page, the overlapping portion 62C between the head modules 61C and 61D has no continuous non-ejection region, that is, the head modules 61C and 61D constitute a cooperative head module group. The cumulative printing rate up to the third page in the head module 61C is calculated as follows:

70+68=138(%).

Moreover, the cumulative printing rate up to the third page in the head module 61D is calculated as follows:

65+60=125(%).

The difference therebetween is not less than the threshold value of 5(%). Accordingly, the head module 61C having a larger cumulative printing rate sum is selected as a reference head module. In that case, a reversing operation is performed on the head module 61C, and the head module 61D is processed in conjunction with the head module 61C.

In FIGS. 24A and 24B, in all the head modules 61A to 61F, with regard to the respective cumulative printing rates of the nozzle rows 72U and 72D to the third page and the printing rates of the nozzle rows 72U and 72D for the fourth page, the nozzle row 72U have higher values than the nozzle row 72D. Accordingly, for the fourth page, as shown in FIG. 24C, in all the head modules 61A to 61F, the correspondences of the ejection data to the nozzle rows 72U and 72D are reversed from those shown in FIG. 24B.

Moreover, for all the head modules 61, the controller 4 may perform control for reversing the correspondence of the upstream nozzle row ejection data and the downstream nozzle row ejection data to the nozzle rows 72U and 72D in predetermined units of printing. The unit of printing may be, for example, 1 page.

The control for reversing the correspondence of the ejection data to the nozzle rows 72U and 72D in predetermined units of printing can distribute printing rates between the nozzle rows 72U and 72D. This prevents a large ink temperature difference between the regions 81U and 81D in each of the head modules 61 of the inkjet head 50 and reduces an ink temperature deviation from the proper temperature range. This can alleviate the reduction in the time during which printing can be performed at ink temperatures within the proper temperature range. As a result, the degradation of print quality caused by an ink temperature deviation from the proper temperature range can be alleviated.

Moreover, since the control is just for reversing the correspondence of the ejection data to the nozzle rows 72U and 72D in predetermined units of printing, the ink temperature difference between the regions 81U and 81D can be reduced by processing which places just a light load on the controller 4.

Moreover, since the correspondence of the ejection data to the nozzle rows 72U and 72D is reversed in predetermined units of printing in all the head modules 61, it is possible to avoid the degradation of print quality in the overlapping portions caused by the correspondences of ejection data to the nozzle rows 72U and 72D which are reverse to each other between adjacent head modules 61.

(Sixth Embodiment)

Figure 25:
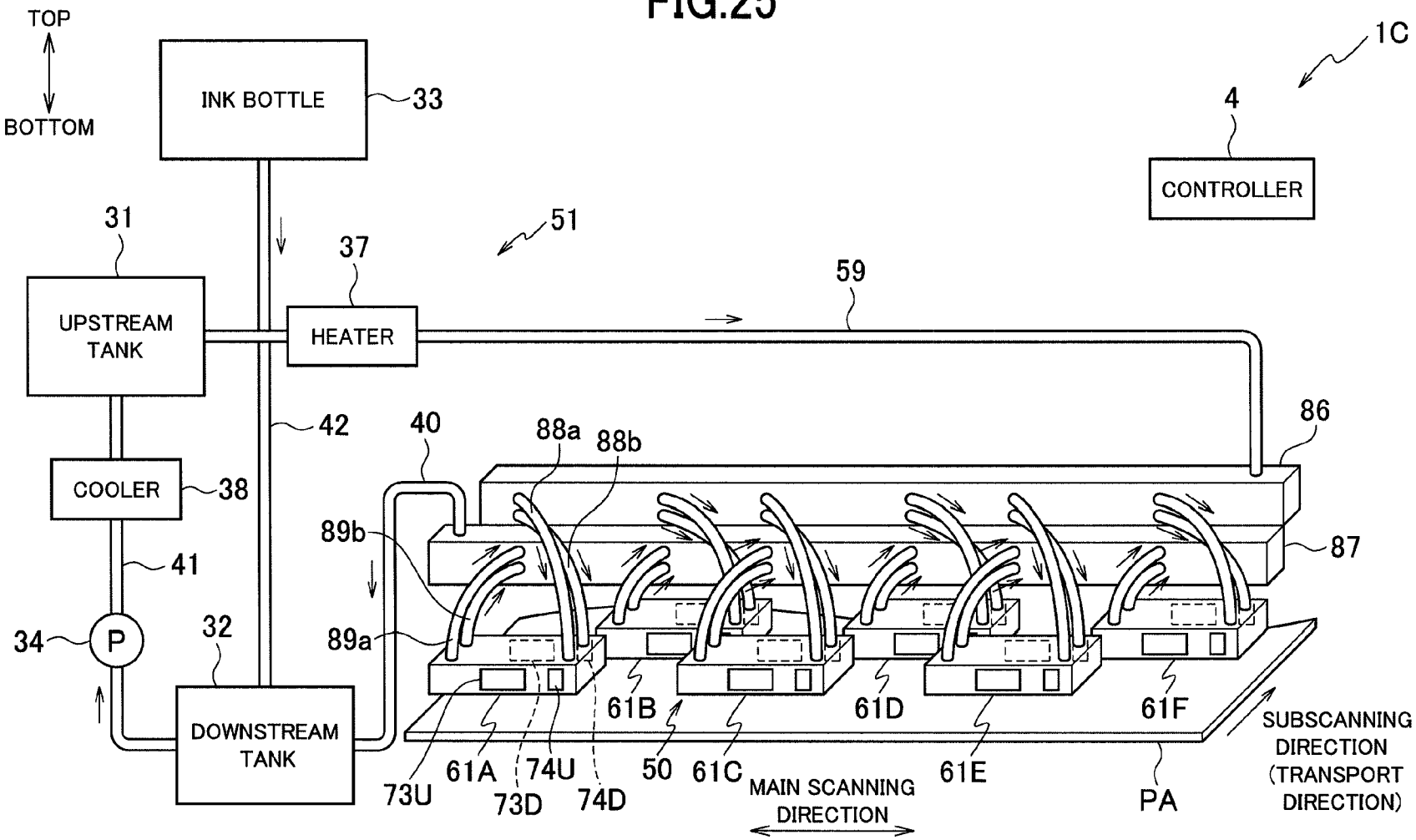
FIG. 25 is a view schematically showing the configuration of an inkjet printer according to a sixth embodiment.
Figure 26:
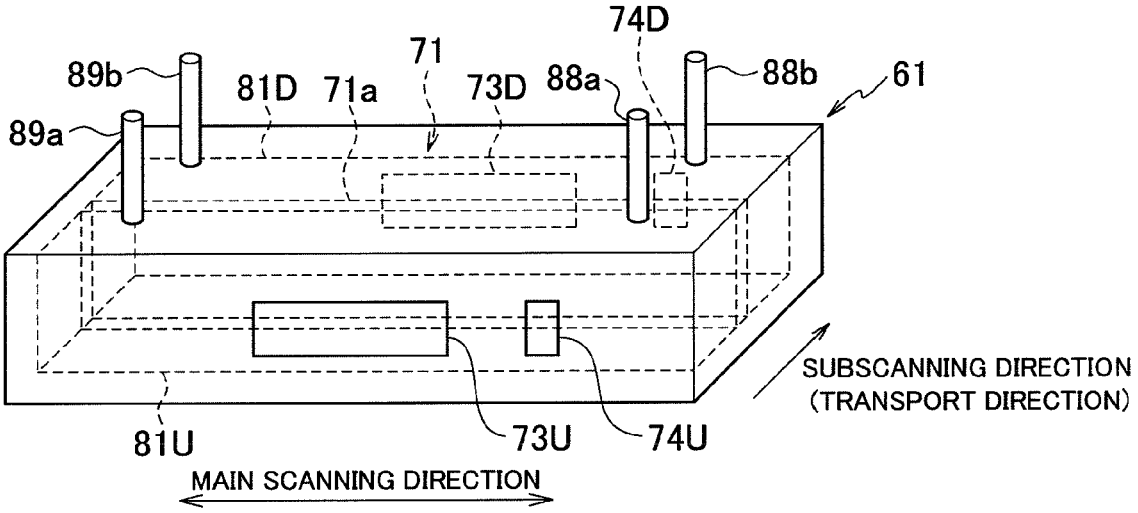
FIG. 26 is a view schematically showing the configuration of a head module of the inkjet printer shown in FIG. 25.

Next, a sixth embodiment will be described. FIG. 25 is a view schematically showing the configuration of an inkjet printer according to the sixth embodiment. FIG. 26 is a view schematically showing the configuration of a head module of the inkjet printer shown in FIG. 25.

As shown in FIGS. 25 and 26, an inkjet printer 1C according to the sixth embodiment has a configuration obtained by adding temperature sensors 74U and 74D to the head modules 61 of the inkjet printer 1B shown in FIG. 14.

The temperature sensors 74U and 74D detect ink temperatures in the regions 81U and 81D of the ink chamber 71, respectively. The temperature sensors 74U and 74D correspond to the temperature sensor described in the appended claims.

In the inkjet printer 1C, the controller 4 selects a reference head module using ink temperatures detected by the temperature sensors 74U and 74D in the head modules 61 of a cooperative head module group. Specifically, the controller 4 selects as a reference head module the head module 61 in which the temperature sensors 74U and 74D have detect a highest temperature in the cooperative head module group.

Next, an explanation of the control of the correspondence of the ejection data to the nozzle rows 72U and 72D in the inkjet printer 1C will be made with reference to a flowchart in FIG. 27. Processing represented by the flowchart in FIG. 27 is performed on each head module 61 for each page to be printed.

Figure 27:
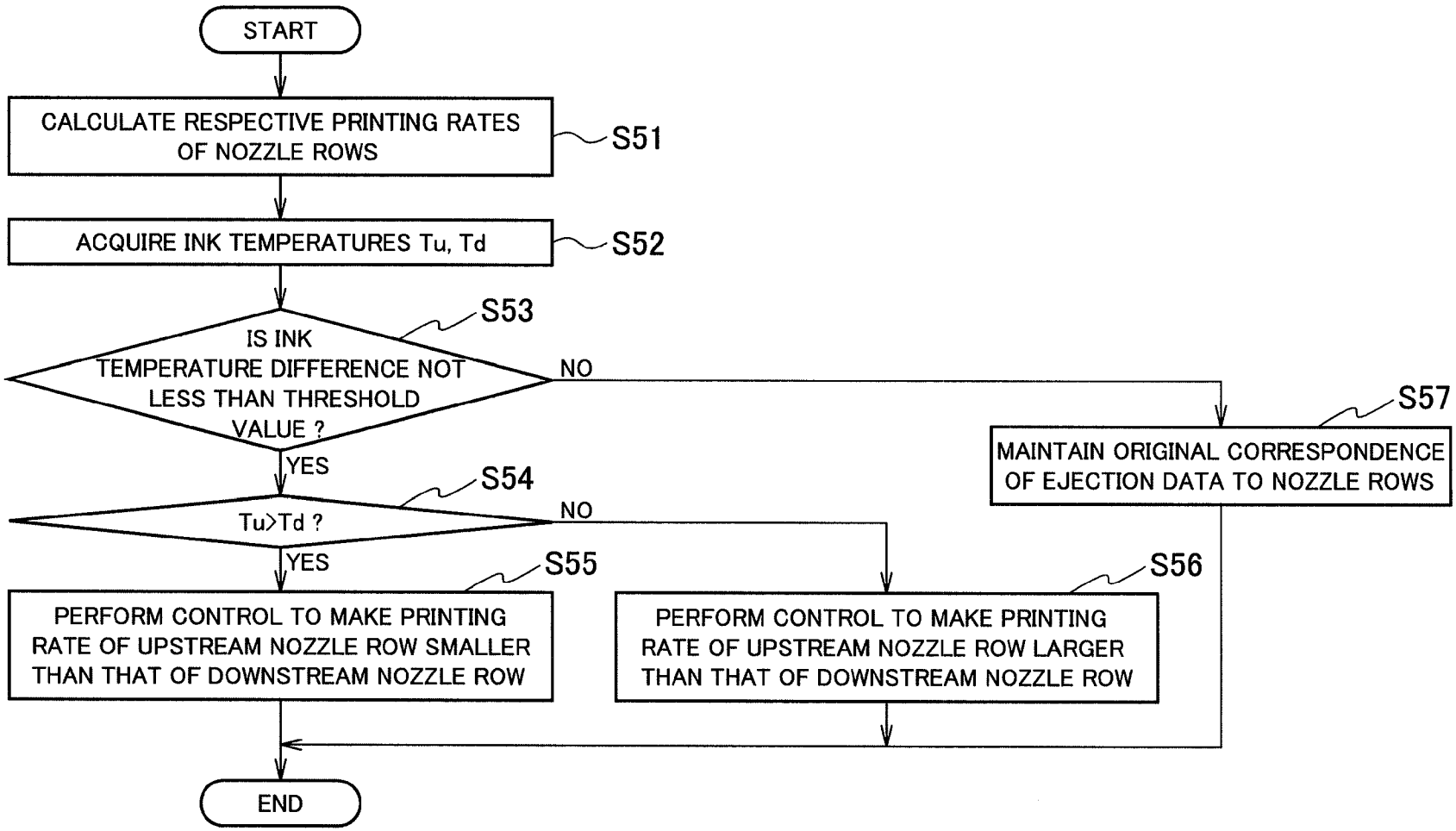
FIG. 27 is a flowchart for explaining the control of the correspondence of ejection data to the nozzle rows in the sixth embodiment.

In step S51 of FIG. 27, the controller 4 calculates the printing rates for the current page for the nozzle rows 72U and 72D of the head module 61 which is an object of processing. Specifically, the controller 4 calculates the printing rate of the head module 61 as an object of processing for the current page in the upstream nozzle row ejection data, and that in the downstream nozzle row ejection data.

Then, in step S52, the controller 4 acquires ink temperature Tu in the region 81U of the ink chamber 71 of the head module 61 as an object of processing, from the temperature sensor 74U. Moreover, the controller 4 acquires ink temperature Td in the region 81D from the temperature sensor 74D.

Subsequently, in step S53, the controller 4 determines whether or not the ink temperature difference |Tu−Td| between the regions 81U and 81D is not less than a threshold value.

If the controller 4 determines that the ink temperature difference |Tu−Td| is not less than the threshold value (step S53: YES), the controller 4 determines in step S54 whether Tu>Td is satisfied or not.

If the controller determines that Tu>Td is satisfied (step S54: YES), the controller 4 determines in step S55 the correspondence of the ejection data to the nozzle rows 72U and 72D in the head module 61, as an object of processing, so that the printing rate of the upstream nozzle row 72U may be smaller than the printing rate of the downstream nozzle row 72D.

If in step S54 the controller 4 determines that Tu≤Td is satisfied (step S54: NO), the controller 4 determines in step S56 the correspondence of the ejection data to the nozzle rows 72U and 72D in the head module 61, as an object of processing, so that the printing rate of the upstream nozzle row 72U may be larger than the printing rate of the downstream nozzle row 72D.

If in step S53 the controller 4 determines that the ink temperature difference |Tu−Td| is less than the threshold value (step S53: NO), the controller 4 maintains the original correspondence of the ejection data to the nozzle rows 72U and 72D in step S57.

After the respective correspondences of the ejection data to the nozzle rows 72U and 72D have been determined as described above for all the head modules 61A to 61F, the controller 4 carries out printing based on the determined correspondences.

As described above, in the sixth embodiment, the controller 4 controls the correspondence of the ejection data to the nozzle rows 72U and 72D using the ink temperatures Tu and Td detected by the temperature sensors 74U and 74D and printing rates. Thus, the ink temperature difference between the regions 81U and 81D can be controlled with high accuracy.

Moreover, the controller 4 selects a reference head module using the detected ink temperatures. As described previously, in a cooperative head module group, it is appropriate that the head module 61 having a highest ink temperature is selected as a reference head module. In the sixth embodiment, since the detected ink temperatures are used, a reference head module can be easily selected which is appropriate for a reference for the control of the correspondence of the ejection data to the nozzle rows 72U and 72D in a cooperative head module group.

The present invention is not limited to the above-described embodiment itself, but, in a practical phase, can be realized by modifying components without departing from the spirit of the invention. Moreover, various inventions can be formed using appropriate combinations of some of the components disclosed in the above-described embodiment. For example, in the embodiment, some of all the components described therein may be deleted. Further, components of different embodiments may be appropriately combined.

What is claimed is:

1. An inkjet printer comprising:

an inkjet head including a first nozzle row, a second nozzle rows, and an ink chamber, each of the first and second nozzle rows including a plurality of nozzles arranged at predetermined intervals along a main scanning direction perpendicular to a transport direction of a sheet of paper transported, the nozzles in the first nozzle row being shifted from the nozzles in the second nozzle row in the main scanning direction, the first and second nozzle rows being spaced apart from each other in the transport direction, the ink chamber partitioned into a first region to store ink to be ejected from the first nozzle row and a second region to store ink to be ejected from the second nozzle row, the ink chamber configured to store ink distributed from a common conduit and supplied to the first and second regions, the inkjet head configured to eject ink from the nozzles in the first and second nozzle rows onto the sheet of paper transported; and a controller configured to perform control based on first ejection data and second ejection data so that the nozzles in the first and second nozzle rows perform printing by ejecting the ink line by line, wherein the controller performs printing while controlling a correspondence of the first and second ejection data to the first and second nozzle rows so that an ink temperature difference between the first region and the second region caused by ink ejection operations is made smaller than that in a case where printing is performed with a fixed correspondence of the ejection data to the nozzle rows.

2. The inkjet printer according to claim 1, wherein the controller performs control for reversing the correspondence of the first and second ejection data to the first and second nozzle rows in predetermined units of printing.

3. The inkjet printer according to claim 1, wherein the controller controls the correspondence of the ejection data to the nozzle rows using printing rates for each page in the first and second ejection data.

4. The inkjet printer according to claim 1, further comprising:

a temperature sensor configured to detect ink temperatures in the first and second regions, wherein the controller controls the correspondence of the ejection data to the nozzle rows using printing rates for each page in the first and second ejection data and the ink temperatures in the first and second regions detected by the temperature sensor.

5. The inkjet printer according to claim 1, wherein the inkjet head includes a plurality of head modules arranged along the main scanning direction in a staggered manner, each of the head modules includes the first and second nozzle rows and the ink chamber, the controller controls the correspondence of the first and second ejection data to the first and second nozzle rows for each of the head modules so that an ink temperature difference between the first region and the second region caused by ink ejection operations is made smaller than that in a case where printing is performed with a fixed correspondence of the ejection data to the nozzle rows, and in printing of each page, when overlapping portions between the head modules include an overlapping portion without a continuous non-ejection region in which nozzles continuous in the main scanning direction are not to eject ink in printing performed with the original correspondence of the first and second ejection data to the first and second nozzle rows, the controller controls a cooperative head module group consisting of a plurality of the head modules continuous with each other across the overlapping portion without the continuous non-ejection region such that respective correspondences of the first and second ejection data to the first and second nozzle rows in the head modules of the cooperative head module group are controlled in conjunction with each other.

6. The inkjet printer according to claim 5, wherein the controller controls the correspondence of the first and second ejection data to the first and second nozzle rows in each of the head modules so that a relation of inequality between printing rates of the first and second nozzle rows for a previous page or a relation of inequality between cumulative printing rates of the first and second nozzle rows up to the previous page is reverse to a relation of inequality between printing rates of the first and second nozzle rows for a current page, and in printing of a page involving the cooperative head module group, the controller selects a reference head module from the cooperative head module group and controls the respective correspondences of the first and second ejection data to the first and second nozzle rows in the head modules of the cooperative head module group in conjunction with each other so that the relation of inequality between the printing rates of the first and second nozzle rows for the previous page or the relation of inequality between the cumulative printing rates of the first and second nozzle rows up to the previous page is reverse to the relation of inequality between the printing rates of the first and second nozzle rows for the current page in reference head module.

7. The inkjet printer according to claim 6, wherein the controller selects the reference head module using a sum of the cumulative printing rates of the first and second nozzle rows in each of the head modules of the cooperative head module group.

8. The inkjet printer according to claim 5, wherein in all the head modules, the controller performs control for reversing the correspondence of the first and second ejection data to the first and second nozzle rows in predetermined units of printing.

9. The inkjet printer according to claim 5, further comprising:

a temperature sensor configured to detect respective ink temperatures in the first and second regions in each of the head modules, wherein in each of the head modules, if an ink temperature difference between the first region and the second region is not less than a threshold value, the controller controls the correspondence of the first and second ejection data to the first and second nozzle rows so that one of the first and second nozzle rows to eject ink having a higher temperature has a lower printing rate, and in printing of a page involving the cooperative head module group, the controller selects a reference head module from the cooperative head module group and, if the ink temperature difference between the first region and the second region in the reference head module is not less than the threshold value, controls the respective correspondences of the first and second ejection data to the first and second nozzle rows in the head modules of the cooperative head module group in conjunction with each other so that one of the first and second nozzle rows to eject ink having a higher temperature has a lower printing rate in the reference head module.

10. The inkjet printer according to claim 9, wherein the controller selects the reference head module using ink temperatures detected by the temperature sensors in the head modules of the cooperative head module group.

* * * * *